US006497623B2

(12) United States Patent
Mirfin et al.

(10) Patent No.: US 6,497,623 B2
(45) Date of Patent: Dec. 24, 2002

(54) AMUSEMENT DEVICE

(76) Inventors: Brian Mirfin, Unit 1, 17 Woodroffe Avenue, Main Beach, Queensland (AU); Walter Pondorfer, A-9991 Dolsach 68, Tirol (AT)

( * ) Notice: Subject to any disclaimer, the term of this patent is extended or adjusted under 35 U.S.C. 154(b) by 0 days.

(21) Appl. No.: 09/949,685

(22) Filed: Sep. 10, 2001

(65) Prior Publication Data

US 2002/0061784 A1 May 23, 2002

Related U.S. Application Data

(63) Continuation of application No. 09/331,473, filed as application No. PCT/AU99/00184 on Mar. 18, 1999, now Pat. No. 6,319,140.

(30) Foreign Application Priority Data

| | | |
|---|---|---|
| Mar. 18, 1998 | (AU) | PP2447 |
| Mar. 19, 1998 | (AU) | PP2467 |
| Oct. 20, 1998 | (AU) | PP6613 |
| Nov. 17, 1998 | (AU) | PP7138 |

(51) Int. Cl.[7] ..... A63G 31/00
(52) U.S. Cl. ..... 472/131; 472/136
(58) Field of Search ..... 472/118, 119, 472/125, 131, 135, 136, 137, 42

(56) References Cited

U.S. PATENT DOCUMENTS

| | | | |
|---|---|---|---|
| 5,113,981 | A | 5/1992 | Lantz |
| 5,203,744 | A | 4/1993 | Checketts |
| 5,421,783 | A | 6/1995 | Kockelman et al. |
| 5,624,321 | A | 4/1997 | Snyder |
| 5,632,686 | A | 5/1997 | Checketts |
| 5,649,866 | A | 7/1997 | Balwanz |
| 5,842,928 | A | 12/1998 | McGinnis |
| 5,893,802 | A | 4/1999 | Bohm |

FOREIGN PATENT DOCUMENTS

| | | |
|---|---|---|
| AU | 656110 | 1/1995 |
| DE | 4335452 | 4/1995 |

*Primary Examiner*—Kien T. Nguyen
(74) *Attorney, Agent, or Firm*—Handal & Morofsky

(57) ABSTRACT

An amusement device, such as a sling-shot machine, for successively propelling and retarding a rider to cause the rider to undergo a vertically oscillatory motion. The amusement device comprises cables (31, 32) one end of each of which is connected to a carrier (19) for supporting one or more riders. A releasable anchoring means is provided for releasably anchoring the carrier (19) at a launch site (17). An elastic structure (71) has opposed ends between which the elastic structure can undergo extension and contraction. One end of the elastic structure (71) is connected to a first support means (57). Each cable (31, 32) passes around a support tower (11) and has a section thereof winding back and forth between first and second guide means (83, 85). The first guide means (83) is connected to the other end of the elastic structure (71) and the second guide means (85) is connected to a second support means (47). The winding section of the cable (31, 32) provides a link between the elastic structure (71) and the second support means (47). A hydraulic ram (67) is provided for tensioning the elastic structure (71) prior to release of the anchoring means whereby energy stored in the loaded elastic structure (71) is transferred to the cables (31, 32) to cause upward propulsion of the carrier (19) on release of the anchoring means.

33 Claims, 18 Drawing Sheets

AMUSEMENT DEVICE

CROSS REFERENCE TO RELATED APPLICATION

This application is a continuation of my application Ser. No. 09/331,473 filed Aug. 18, 1999, now U.S. Pat. No. 6,359,140, which is a 371 of PCT/AU99/00184 filed Mar. 18, 1999 the disclosure of which is hereby incorporated herein by reference thereto.

TECHNICAL FIELD

The invention relates to an amusement device of the type in which one or more cables are used to successively propel and retard a rider to cause the rider to undergo a vertically oscillatory motion.

BACKGROUND OF THE INVENTION

The amusement device according to the invention is particularly, although not solely, suitable for use in bungee jumping operations in which an elastic cord is employed to arrest the fall of a participant, and in reverse bungee jumping operations and so-called "sling-shots" in which participants are propelled upwardly under the influence of elastic cords. One such sling-shot is disclosed in Australian Petty Patent 656110.

The elastic cords which are utilised in the amusement devices of the type referred to above typically comprise a multitude of strands of rubber wound between two spaced-apart end spools and then bound together with elastic binding. While such elastic cords do allow the amusement devices to operate effectively, they also have deficiencies. One such deficiency is a tendency for the rubber strands to deteriorate under the effect of heat generated within the elastic cords as they undergo extension and contraction, and as they rub one against another. The heat generated can cause degradation of the strands, particularly in the region near the spools. Additionally, the heat which is generated cannot readily dissipate from the central region of each elastic cord and so heat accumulates in that region. Consequently, the central region of the elastic cord becomes hotter, causing the inner strands to deteriorate more rapidly than the outer strands. The inner strands are therefore more likely to fail before the outer strands. This can lead to a dangerous situation as the deteriorating inner strands are masked by the outer strands and so may not be visible. The degradation can lead to rupturing of the strands and consequently a reduction in the loading capacity of the elastic cords. In view of this degradation of the elastic cords, it is necessary to replace the cords on such amusement devices at regular intervals, which leads to an increase in operating costs and possible loss of operation time. Further, the elastic cords need to be protected from extensive exposure to sunlight as they can deteriorate under the effect of ultra-violet radiation. A still further deficiency of the elastic cords is that they can be time-consuming and dangerous to construct, the danger arising from the possibility of the stretched rubber strands breaking during the construction process and causing injury to the person carrying out the process.

SUMMARY OF THE INVENTION

It would be advantageous to provide amusement devices of the type described with an alternative to elastic cords so as to avoid the deficiencies referred to above.

The invention provides an amusement device comprising a cable adapted to support one or more participants, and a mechanical system comprising first and second guide means between which a section of the cable winds back and forth, the first and second guide means being yieldingly movable elastically with respect to each other.

Throughout this specification, the term "cable" shall be taken to include a cable, cord, rope, chain and like elongate flexible elements, and any combination thereof.

The mechanical system may further comprise an elastic structure having opposed ends between which the elastic structure can undergo extension and contraction, one of the first and second guide means being operatively connected to the elastic structure whereby tensioning of said cable is adapted to cause shortening of said winding section and thereby loading of the elastic structure to store strain energy therein, the stored energy or at least part thereof, being returned to the cable upon a reduction in loading on the cable.

Preferably, said first and second guide mans are connected to the ends of the elastic structure. In one arrangement, one end of the elastic structure is connected to a first support means, the first guide means being connected to the other end of the elastic structure and the second guide means being connected to a second support means, said winding section of the cable providing a link between the elastic structure and the second support means, whereby tensioning of the cable is adapted to cause shortening of the link and thereby said loading of the elastic structure.

The invention also provides an amusement device comprising a cable adapted to support one or more riders, an elastic structure having opposed ends between which the elastic structure can undergo extension and contraction, the cable having a section thereof winding back and forth between first and second guide means one of which is operatively connected to the elastic structure whereby tensioning of said cable is adapted to cause shortening of said winding section and thereby loading of the elastic structure to store strain energy therein, the stored energy or at least part thereof being returned to the cable upon a reduction in loading on the cable.

The present invention also provides an amusement device comprising a cable one end of which is adapted to support one or more riders, an elastic structure having opposed ends between which the elastic structure can undergo extension and contraction, one end of the elastic structure being connected to a first support means, the cable having a section thereof winding back and forth between first and second guide means, the first guide means being connected to the other end of the elastic structure and the second guide means being connected to a second support means, said winding section of the cable providing a link between the elastic structure and the second support means, whereby tensioning of said cable upon motion of said one or more riders in one direction is adapted to cause shortening of the link and thereby extension of said elastic structure to store strain energy therein and consequently retard said motion of said one or more riders in said one direction, the stored energy or at least part thereof being returned to the cable upon a reduction in loading on the cable thereby to allow lengthening of the link between the elastic means and the second support and consequently induce motion of said one or more riders in a generally reverse direction.

The present invention also provides an amusement device comprising a launch site, means providing a plurality of support locations elevated above and horizontally offset from the launch site, a support structure for supporting one or more riders, a plurality of cables one end of each of which is connected to the support structure, releasable anchoring means for releasably anchoring the support structure to the launch site, an elastic structure having opposed ends between which the elastic structure can undergo extension and contraction, one end of the elastic structure being connected to a first support means, each cable passing around a respective one of the support locations and having a section thereof winding back and forth between first and second guide means, the first guide means being connected to the other end of the elastic structure and the second guide means being connected to a second support means, said winding section of the cable providing a link between the elastic structure and the second support means, and loading means for loading the elastic structure prior to release of said anchoring means whereby energy stored in the loaded elastic structure is transferred to the cable to cause upward propulsion of the support structure on release of the anchoring means.

The elastic structure may be loaded by tensioning the elastic structure.

The first and second guide means may each comprise a plurality of pulley wheels about which the cable turns as it follows its winding path.

The first and second guide means may be arranged in groups, and the cable may comprise a plurality of cable members operating in tandem, each cable member winding back and forth between the first and second guide means in a respective one of the groups.

The elastic structure may take any suitable form. The elastic structure may, for example, comprise a spring system. The spring system may comprise (a) one or more extension springs, (b) one or more compression springs, or (c) a combination of extension and compression springs, arranged in an appropriate working configuration. The or each spring may comprise a mechanical spring such as helical spring, a block or other body of elastic material such as rubber, an elastic cable such as bungee cord, a pneumatic spring, or a spring operable by expansion of a working fluid (such as by explosion). In one particular arrangement, the spring system may comprise a plurality of helical extension springs arranged in series.

In circumstances where the cable is to apply a propelling force to the one or more riders a tensioning means may be provided for extending the elastic structure to store strain energy therein prior to propulsion of the one or more riders.

Typically, the elastic structure would undergo an oscillatory motion involving a series of successive extensions and contractions, and the one or more riders connected to the cable would be caused to undergo corresponding oscillatory motion.

A particular feature of the amusement device according to the invention is that is can provide a dampening effect on the oscillatory motion which the one or more riders are undergoing. The dampening effect may arise from energy losses within the elastic structure and through friction within the amusement device.

In one form, the loading means may comprise a power device for moving the first and second support means with respect to each other to increase the spacing therebetween and thereby load the elastic structure. The power device may comprise a hydraulic ram operating between the first and second support means. The hydraulic ram may also be used to increase the dampening effect on the oscillatory motion of the load. In this regard, the hydraulic circuit in which the hydraulic ram is operating may incorporate means (such as a one-way bleed valve) which would allow the ram to progressively retract as the elastic structure oscillates and thereby dampen the oscillating elastic structure.

In another form, the loading means may comprise a winding mechanism such as a winch coupled to the end of the cable remote from said load whereby said cable can be tensioned by operation of the winding mechanism thereby to decrease the length of the link between the second support means and the elastic structure thereby to store energy in the elastic structure.

Means may be provided for selectively imparting a rapid movement (such as rapid limited extension or rapid limited contraction) to the cable after propulsion of the load in the first instance. In one arrangement, such means may comprise a mechanism for imparting relative movement between the first and second support means thereby to cause extension or contraction of the cable, as the case may be. The mechanism may comprise a further hydraulic ram for operation either in series or in parallel with said hydraulic ram which provides the power device. In another arrangement, such means may comprise a mechanism for rapidly deploying a surplus length of the cable. In this arrangement, the surplus length of cable may be wound about a reel and released as required.

The means providing a plurality of support locations may, for example, comprise a separate structure defining each support location or a common structure defining the plurality of support locations.

Where the support locations are each defined by a separate support structure, each such support structure may, for example, comprise a tower. The tower may be constructed as a space frame. The two may extend vertically, with the respective support location being positioned above the base of the tower, or the tower may provide a horizontal reach between the support location and the base of the tower. In the latter case, the tower may be in the form of an arched jib.

Where the support locations are provided by a common structure, such a structure may, for example, comprise a central section and a plurality of lateral sections extending from the central section. With this arrangement, the lateral sections provide a horizontal reach between the base of the central section and the support locations. Each lateral section may comprise an arched jib. Where there are three or more lateral sections, each lateral section may define two support locations, one for each of two adjacent amusement devices. Thus, a structure having three lateral sections can provide three amusement devices according to the invention, and a structure having four lateral sections can provide four amusement devices according to the invention.

The present invention also provides a method of operating an amusement device as set forth above, comprising the steps of:

anchoring the support structure in relation to the launch site;

releasably securing one or more riders to the support structure;

loading the elastic structure to store energy therein;

releasing the support structure from the launch site, whereby energy stored in the loaded elastic structure is transferred to the cable to cause upward propulsion of the support structure, followed by vertical oscillatory motion; and returning the support structure to the launch site at which the one or more riders can be released from the support structure.

The invention still further provides an amusement device comprising a support structure adapted to accommodate a participant, the support structure being moveable from a boarding station at which said participant can enter to the support structure and an elevated condition from which said participant can jump or otherwise depart from the support structure, a cable for connecting said participant to the support structure, an elastic structure having opposed ends between which the elastic structure can undergo extension and contraction, the cable having a section thereof winding back and forth between first and second guide means one of which is operatively connected to the elastic structure whereby tensioning of said cable is adapted to cause shortening of said winding section and thereby loading of the elastic structure to arrest the descent of said participant.

The support structure may be connected to a support cable operable to move the support structure between the boarding station and the elevated condition.

Preferably the support cable is connected to a tower structure.

The invention still further provides an amusement device comprising an elevated support structure from which a participant can jump or otherwise depart, a cable for connecting the participant to the support structure, an elastic structure having opposed ends between which the elastic structure can undergo extension and contraction, the cable having a section thereof winding back and forth between first and second guide means one of which is operatively connected to the elastic structure whereby tensioning of said cable is adapted to cause shortening of said winding section and thereby loading of the elastic structure to arrest the descent of said at least one participant.

The invention will be better understood by reference to the following description of several specific embodiments thereof. The description of the embodiments will be made with reference to the accompanying drawings in which.

Figure 1:
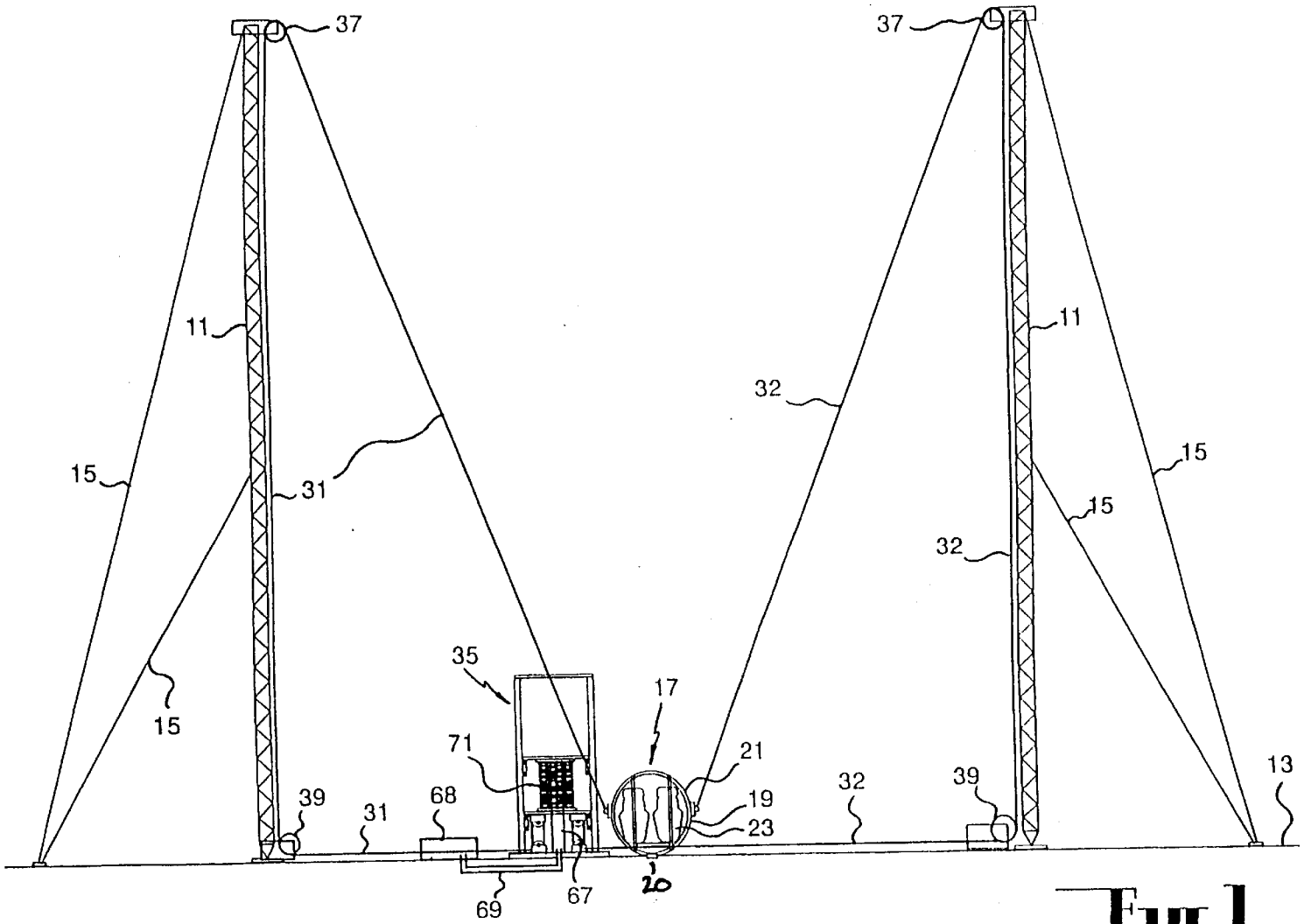
FIG. 1 is a schematic elevational view of an amusement device according to the first embodiment, the amusement device being shown in a condition in which it is not in use.

Referring to FIGS. 1 to 6 of the accompanying drawings, the amusement device according to the first embodiment comprises a pair of spaced apart towers 11 anchored to the ground 13. The towers 11 are of any suitable construction (such as space frames) and are supported by guy wires 15.

The towers 11 are positioned on opposed sides of a launch site 17 at which a support structure in the form of a carrier 19 can be stationed. The carrier 19 is adapted to receive and support one or more riders. The carrier 19 comprises a frame structure 21 accommodating seating 23 and associated restraining means (not shown) for supporting the riders. In this embodiment, the seating 23 comprises two seats positioned in side-by-side relationship.

A releasable anchoring means is provided for releasably anchoring the carrier 19 at the launch site 17. The releasable anchoring means comprises a latching mechanism 20 which is releasably engagable with the frame structure 21 and which is operable by an operator of the ride at a location remote from the launch site.

Two cables 31, 32 extend between the carrier 19 and a mechanical system 35 which is positioned on the ground 13 at a location generally between the two towers 11 but offset from a direct line between the two towers so as to be clear of the launch site 17. The mechanical system 35 is provided to elastically tension the two cables 31, 32 such that the support structure 19 is propelled upwardly from the launch site 17 upon release of the anchoring means and thereafter to elastically arrest subsequent descent of the carrier 19 to establish oscillatory motion, as will be explained in more detail later.

In extending between the frame structure 21 and the mechanical system 35, each cable 31, 32 passes around a pulley wheel 37 supported at the upper end of the respective tower 11 and a lower pulley wheel 39 supported at the base of the tower, and extends alongside the tower between the two pulley wheels. The end of each cable 31, 32 remote from the carrier 19 is fixed at anchoring point 41.

The mechanical system 35 comprises a frame structure 45 comprising a base structure 47, a top structure 49, and four columns 51 extending between the base structure and the top structure, the four columns being positioned one at each corner of the frame structure when viewed in plan. Each column 51 defines a guide rail which is rectangular in cross-section so as to provide a first guide face 53 and a second guide face 55, normal to the first guide face 53, the purpose of each of which will be explained later.

An upper moveable structure 57 and a lower moveable structure 59 are each positioned within the frame structure 45 for reciprocatory movement along the guide rails defined by the columns 51. Each moveable structure 57, 59 is rectangular in plan and has adjacent each corner thereof two depending brackets 61 one to each side of the corner. The brackets 61 are loosely connected to the moveable structure 57, 59 so that they can tilt to a limited extent with respect to the moveable structure. Each depending bracket 61 carries two vertically spaced guide rollers 63. The guide rollers 63 on some of the brackets 61 engage against the guide faces 53, and the guide rollers 63 on others of the brackets 61 engage against the guide faces 55, such engagement serving to constrain movement of the moveable members 57, 59 in a generally vertical direction along the guide rails 51 while allowing a limited degree of sideways tilting movement about a vertical axis corresponding to the direction of travel.

A power device 67 in the form of a hydraulic ram is positioned between the base structure 47 and the upper moveable structure 57 for selectively moving the upper moveable structure 57 with respect to the base structure 47. The hydraulic ram 67 is operably connected to a hydraulic pump assembly 68 via fluid lines 69.

An elastic structure 71 is positioned between the upper moveable structure 57 and the lower moveable structure 59. The elastic structure 71 comprises a spring system in the form of a plurality of helical extension springs 73 positioned in parallel, with one end of each spring being connected to the upper moveable structure 57 which provides a first support means and the other end of each spring being anchored to the lower moveable structure 59. The springs 73 are of course so positioned in relation to the hydraulic ram 67 to avoid interference with its operation.

The mechanical system 35 includes pulley wheels 80 arranged as a first set of pulley wheels 81 and a second set of pulley wheels 82, with the cable 31 winding through the first set of pulley wheels 81 and the cable 32 winding through the second set of pulley wheels 82, as will be explained in more detail later.

Figure 6:
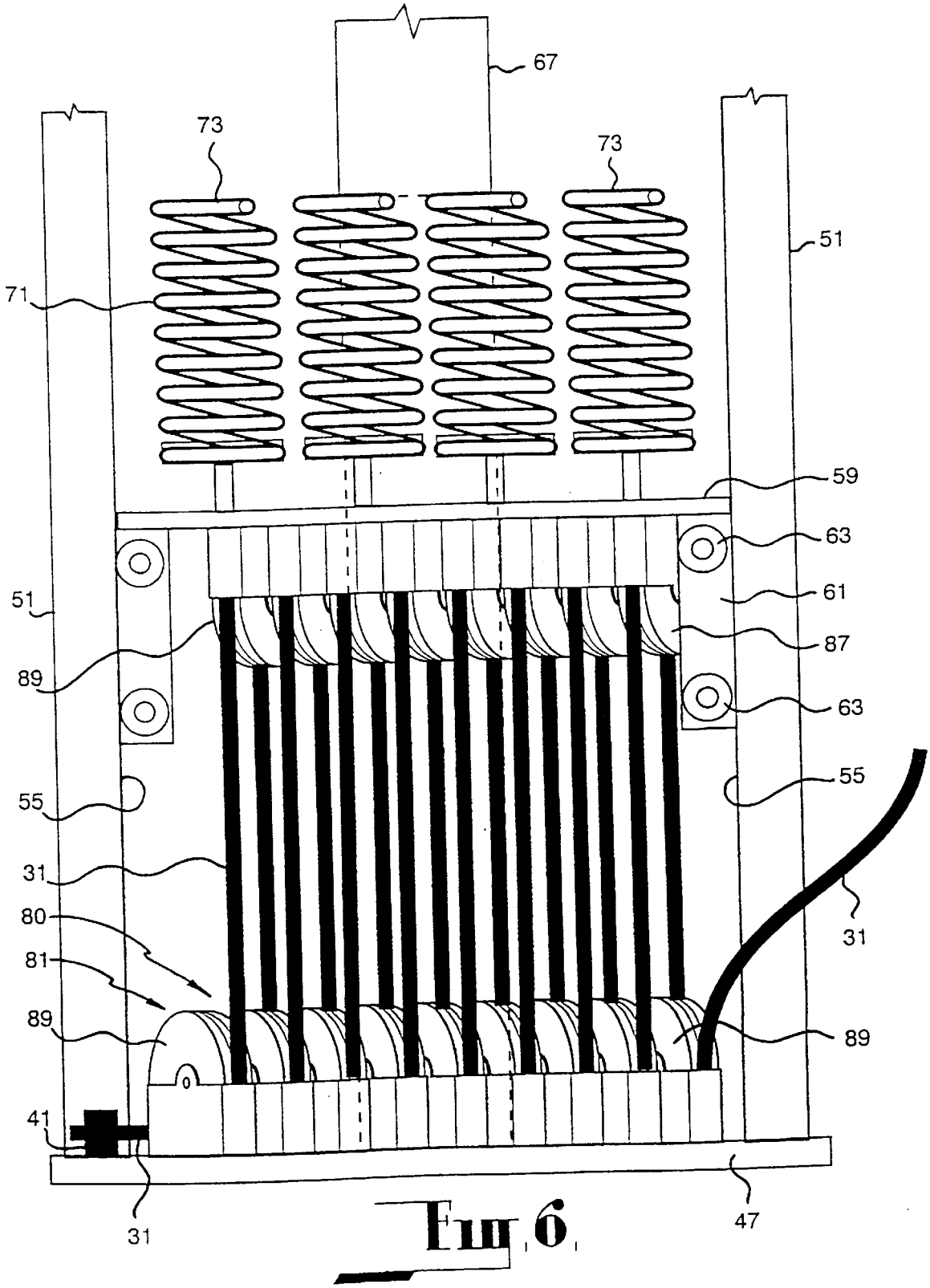
FIG. 6 is a fragmentary view of part of the mechanical system.

The first and second set of pulley wheels 81, 82 each comprise an upper bank of pulley wheels 83 connected to the lower moveable structure 59 and a lower bank of pulley wheels 85 connected to the base structure 47 which provides a second support means. The upper bank of pulley wheels 83 comprise a plurality of pulley wheels 87 positioned in side-by-side relationship, as best seen in FIG. 6 of the drawings. Similarly, the lower bank of pulley wheels 85 comprise a plurality of pulley wheels 89 positioned in side-by-side relationship. The pulley wheels 87 in the upper bank 83 and the pulley wheels 89 in the lower bank 85 are angularly offset with respect to each other (as shown in FIG. 6) so that each cable 31, 32 can successively wind between its respective pulley wheels 89 and 87 without the various lengths of the cable extending therebetween interfering with each other.

With this arrangement, one end of each cable 31, 32 is fixed to the carrier 19 and the other end of the cable is fixed to respective anchor point 41 on the base structure 47, with a section of the cable between the two ends winding between respective upper and lower pulley wheels 87, 89. This can be best seen in FIG. 6 of the drawings where the first cable 31 is shown winding between pulley wheels 87 and 89 of the first set 81 of pulley wheels.

The winding arrangement of the cables 31, 32 between the pulley wheels 87, 89 provides a link between the lower moveable structure 59 and the base structure 47 of the mechanical system. The effective length of the link increases as the lower moveable structure 59 moves upwardly away from the base structure 47, and the effective length of the link reduces as the lower moveable structure 59 moves downwardly in the reverse direction.

Figure 4:
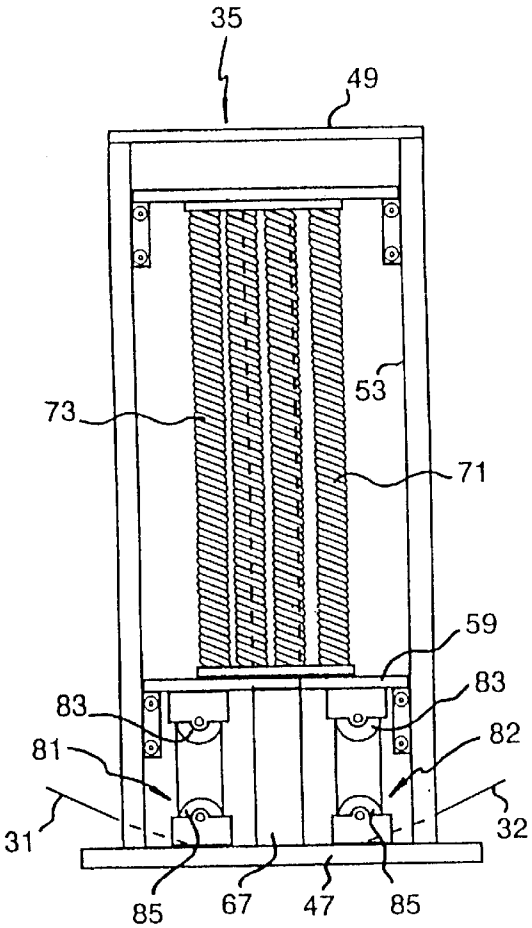
FIG. 4 is a view similar to FIG. 3 with the exception that the mechanical system is shown in a condition in which energy has been stored.
Figure 3:
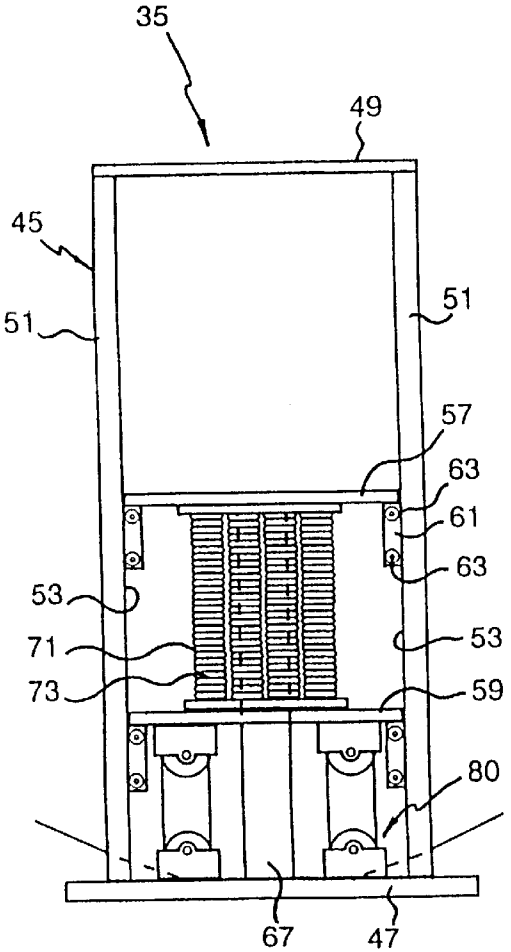
FIG. 3 is a schematic view of a mechanical system for storing and releasing energy for imparting oscillatory motion to a rider using the apparatus, the mechanical system being shown in an inoperative condition.

With the carrier 19 anchored at the launch site 17, extension of the hydraulic ram 67 causes upward movement of the upper moveable structure 57. This upward movement is transferred (to some extent) through the springs 73 to the lower moveable structure 59 which consequently moves upwardly to apply tension to the cables 31, 32. The extent to which the lower moveable member 59 can move upwardly is, of course, limited by tension within the cables 31, 32. Continued upward extension of the hydraulic ram 67 causes the upper moveable structure 57 to move further towards its uppermost position, increasing the spacing between the two moveable structures 57, 59, so loading the springs 73 by tensioning them, as shown in FIG. 4 of the drawings. With the springs 73 under tension, there is strain energy stored in the springs. This stored energy is released and transferred to the cables 31, 32 upon release of the anchoring means.

Figure 2:
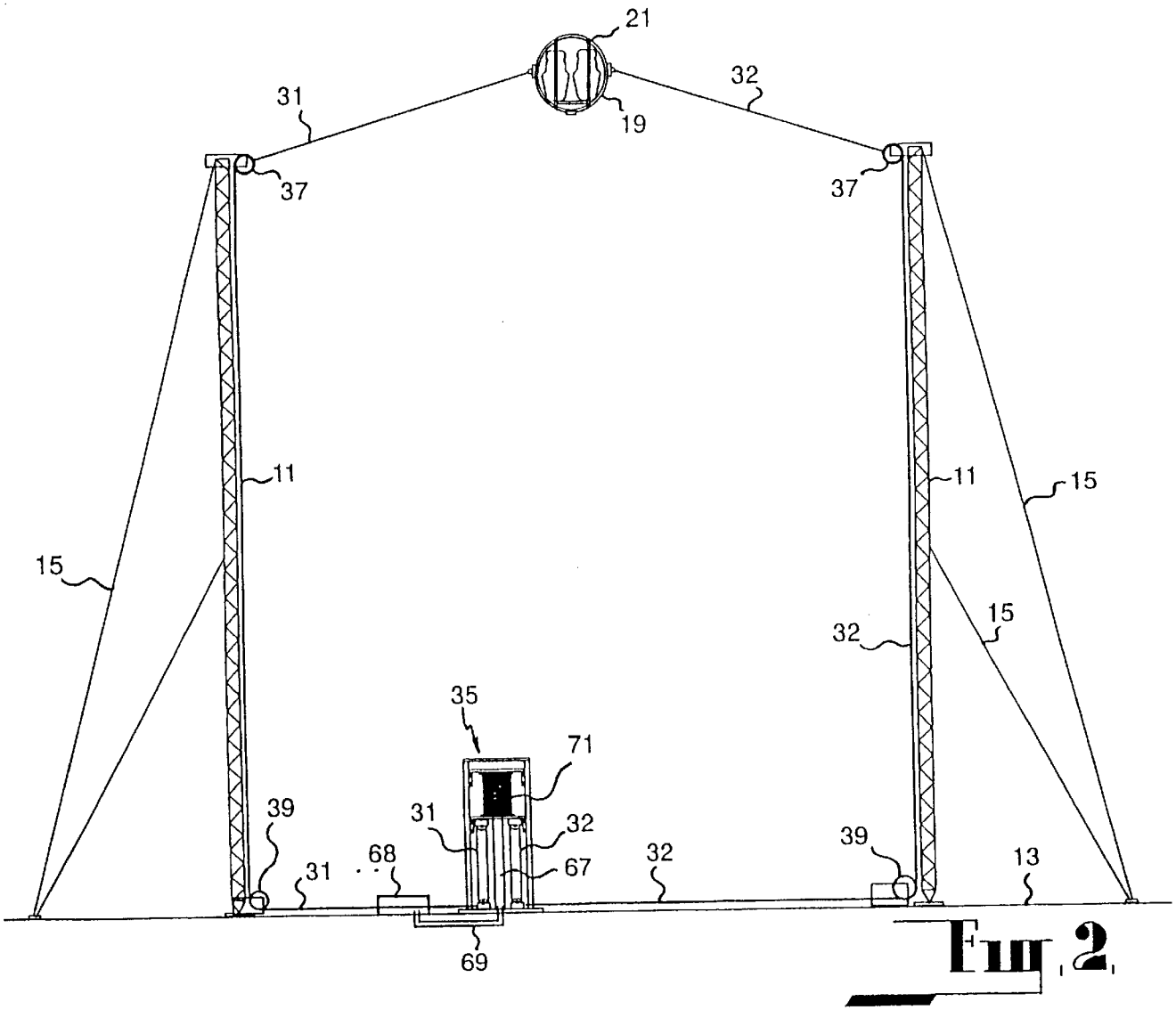
FIG. 2 is a schematic elevational view of the amusement device of FIG. 1 shown in operation.
Figure 5:
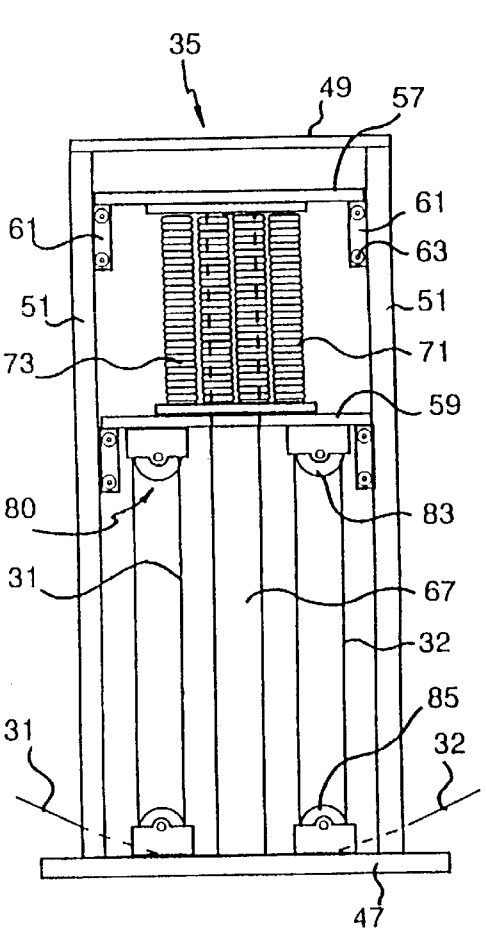
FIG. 5 is also a view similar to FIG. 3 with the exception that the mechanical system is shown in a condition in which energy has been released.

On release of the anchoring means at the launch site 17, the stored energy in the springs 73 propels the lower moveable structure 59 upwardly, as shown in FIG. 5 of the drawings. This causes the effective length of the link between the lower moveable structure 59 and the base structure 47 to increase, resulting in a decrease in the effective length of that section of the cable 31, 32 between the upper pulley wheel 37 and the support structure 19. The energy released by the springs 73 is transferred through the cables 31, 32 which apply a force to the carrier 19 rapidly to propel it vertically, as shown in FIG. 2 of the drawings. The force applied to the carrier 19 by the cables 31, 32 is reduced with respect to the force exerted by the elastic structure 71 by virtue of the compound pulley arrangement provided by the sets of pulley wheels 81, 83. Thus, the compound pulley arrangement, provided by the sets of pulleywheels 81, 83 constitutes a simple machine with an input point and an output point, and with a mechanical advantage of less than one. However, the compound arrangement of the pulley wheels 81, 83 results in the distance travelled by the ends of the cables 31, 32, and consequently the carrier 19 attached thereto, being considerably greater than the distance through which the springs move, the latter corresponding to the extent of increase in the effective length of the link between the lower moveable structure 59 and the base structure 47.

The upwardly moving carrier 19 eventually stops and commences a descent under the influence of gravity. The descent of the carrier 19 is retarded by the cables 31, 32 which commence to undergo tension under the load of the descending carrier 19, thereby pulling the lower moveable carrier 59 downwardly to tension the springs 73, so again storing energy in the springs. As the springs 73 extend, they serve to elastically retard the descent of the carrier 19 through the cables 31, 32 and eventually stop the descent. At this stage, the energy within the springs 73 is again transferred through the cables 31, 32 to again apply an uplifting force to the carrier 19 to propel it upwardly again. This establishes a vertical oscillatory motion which repeats itself but with progressively decreasing amplitude owing to various energy losses including energy losses in the springs 73, friction within the pulley wheels, friction between the moveable structures 57, 59 and the guide rails 51, and air resistance on the carrier 19.

While not shown in the drawings, the hydraulic ram 67 may be provided with a bleed valve which allows the ram to progressively retract during oscillatory motion of the springs 73, thereby providing further dampening to the motion of the carrier 19.

Cooperation between the guide rails 51 and the guide rollers 63 serves to guide the moveable structures 57 and 59 through their reciprocatory movement. The loose nature of the brackets 61 allows the moveable structures to undergo some sideways twisting.

When the vertical oscillatory motion has decreased sufficiently or has stopped, the ram 67 can be allowed to retract thereby causing the effective length of that section of each cable 31, 32 between each upper pulley wheel 37 and the carrier 19 to increase and so lower the carrier 19 to the launch site 17 at which riders can leave the carrier. The amusement device can then be prepared for the next ride.

From the foregoing, it is evident that the amusement ride according to the first embodiment operates in a similar fashion to known sling-shots such as that described in Australian Petty Patent 656110, with the exception that energy for propelling and retarding the carrier 19 is provided by the mechanical system 35 as opposed to elastic cords.

The presence of the springs 73 in the mechanical system 35 introduces a dampening effect which dampens the vertical oscillatory motion of the carrier 19 at a greater rate than dampening provided by elastic cords in existing sling-shots. This is advantageous in that it allows a ride to be concluded more quickly and so allows an increased rate of usage of the amusement device. This earlier conclusion of the ride is not considered disadvantageous to the entertainment value provided by the ride, as the thrill or sensation offered by the ride is primarily provided at the initial upward catapult and several of the vertical oscillations which immediately follow. The subsequent period which simply involves waiting for the vertical oscillatory motion to subside to an extent which allows the riders to be returned to the launch site 17 from which they can leave the carrier 19 provides no significant thrill or sensation, and so a reduction in such oscillations would not be detrimental to the entertainment value of the ride.

The hydraulic ram 67 may be utilised to regulate the characteristic of the ride provided by the amusement device according to the embodiment. Specifically, the extent to which the ram 67 is extended regulates the amount of energy stored in the springs 73 at the time that the carrier 19 is released. Thus, a ride of maximum intensity is available by fully extending the ram 67 and a more subdued ride 15 is available by limiting the extent to which the ram 67 is extended (and consequently limiting the extent to which the springs 73 are extended). The hydraulic ram 67 may be operated by a computer-control system. The computer control system may regulate operation of the ram according to factors such as the weight of the rider or riders.

The visual appeal of the amusement device may be enhanced by providing a lighting system (such as flashing lights) within the region occupied by the springs 73. The interaction between the lighting and the oscillating springs may produce a visual effect which attracts attention and so increases awareness of, and custom to, the amusement device.

Figure 7:
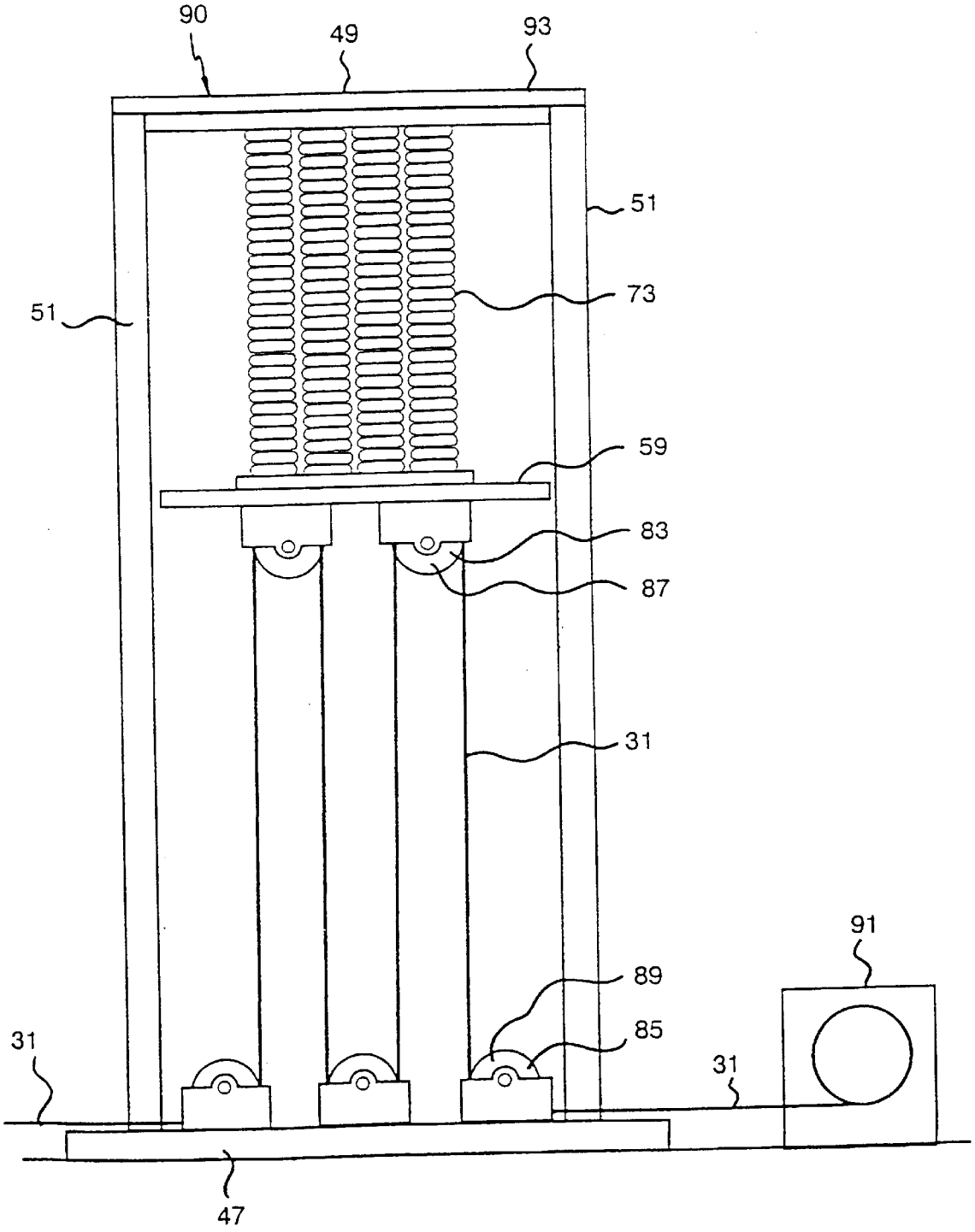
FIG. 7 is a schematic view of a mechanical system for an amusement device according to a second embodiment.
Figure 8:
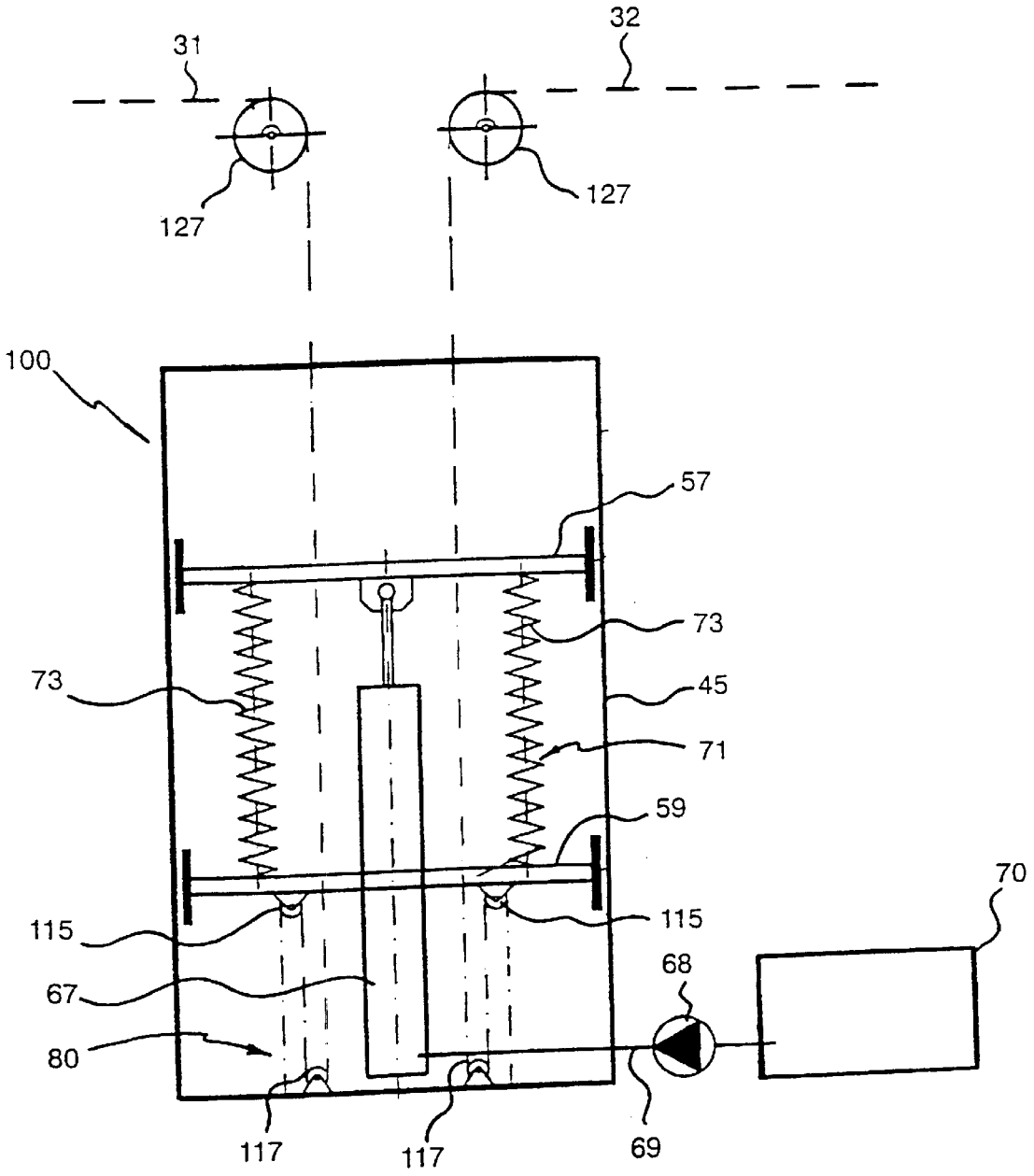
FIG. 8 is a schematic side elevational view of a mechanical system for an amusement device according to a third embodiment.
Figure 9:
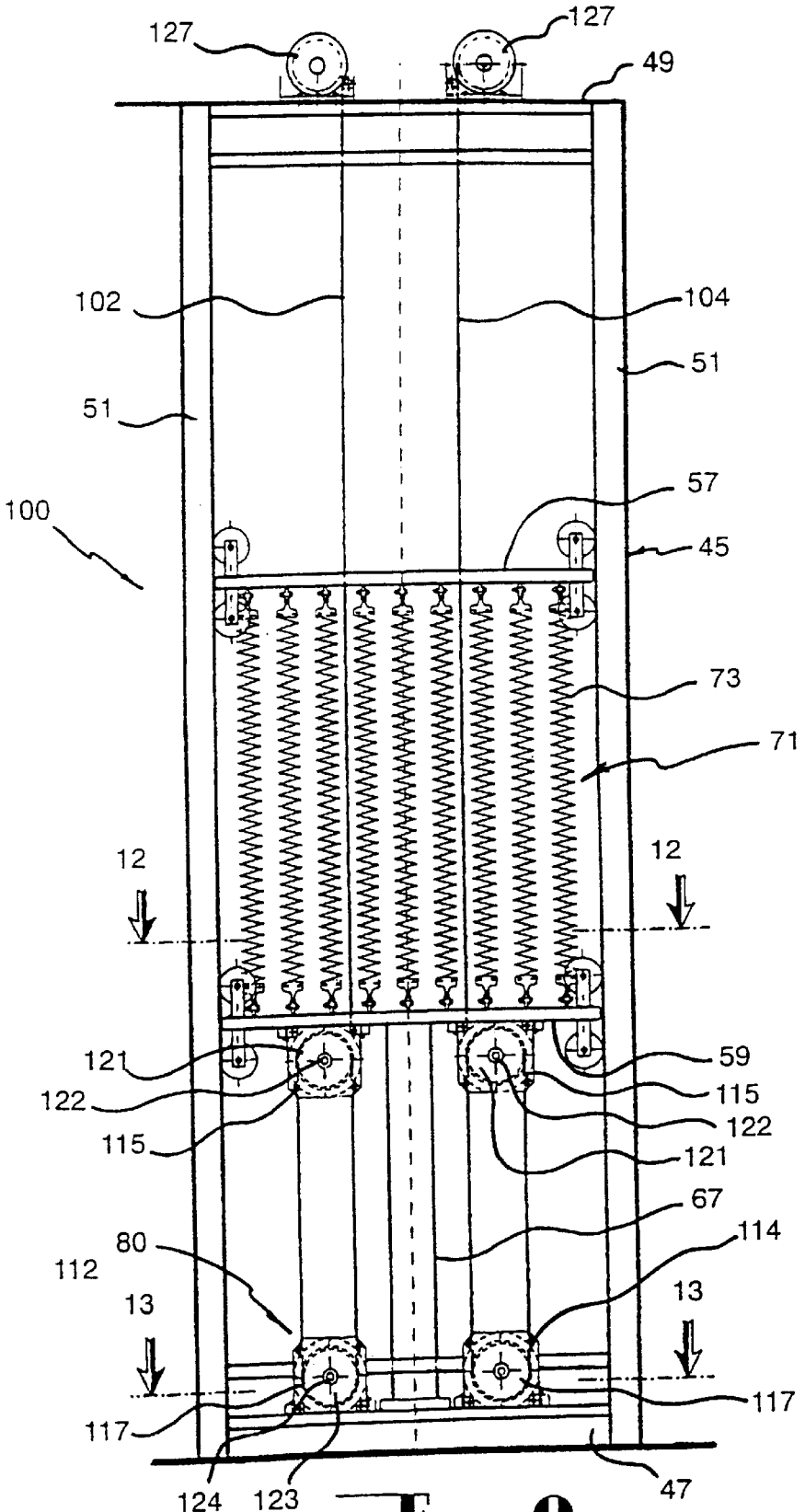
FIG. 9 is a side elevational view of the mechanical system of FIG. 8 shown in more detail.
Figure 10:
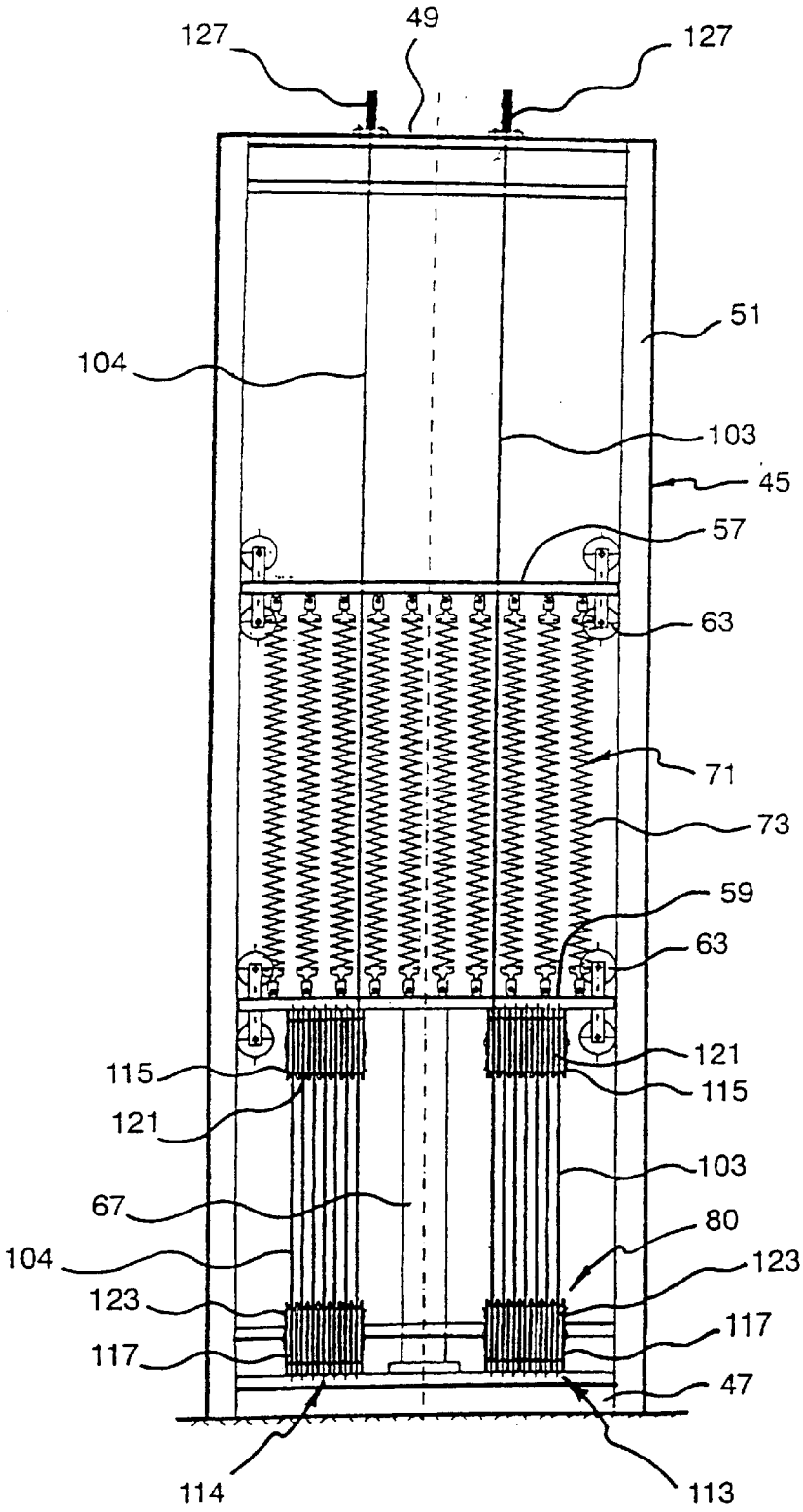
FIG. 10 is an end elevational view of the mechanical system according to the third embodiment.
Figure 11:
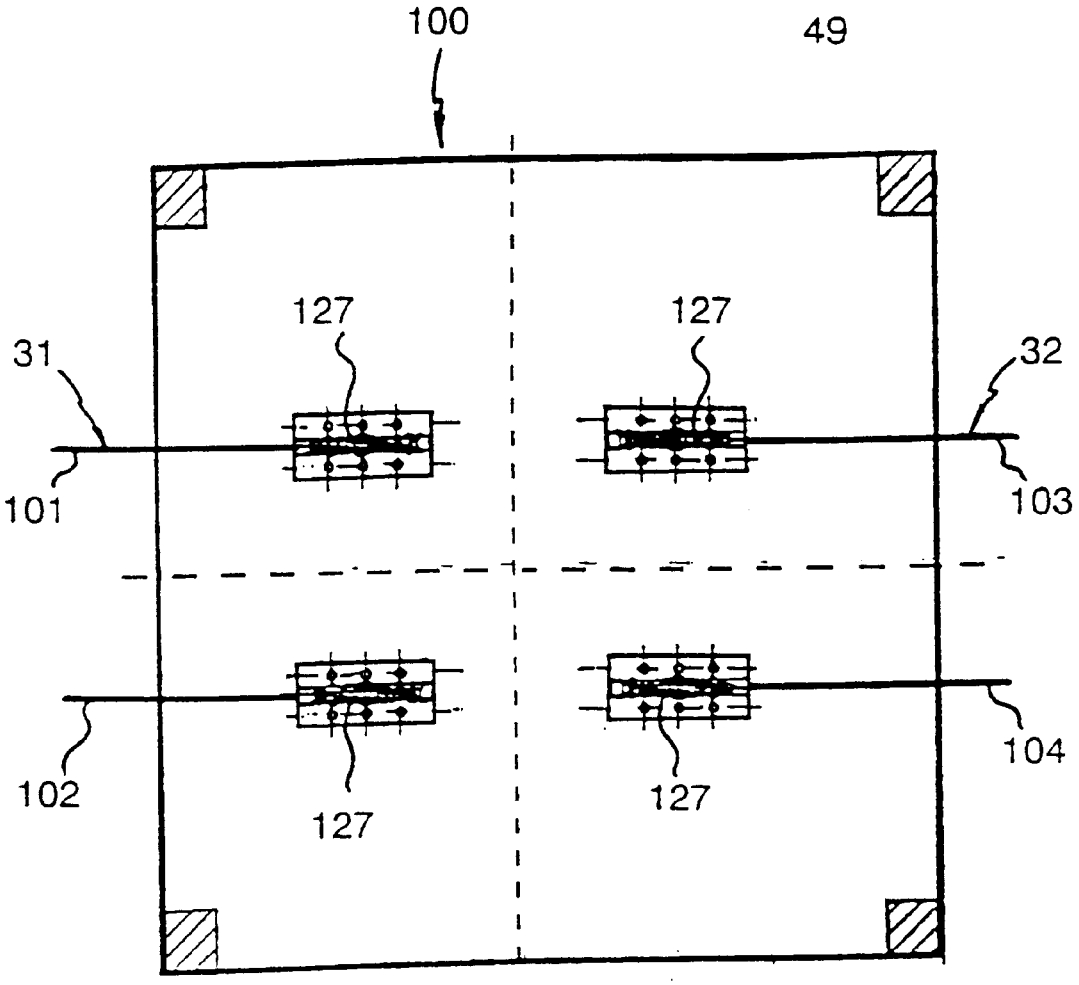
FIG. 11 is a plan view of the mechanical system according to the third embodiment.

Referring now to FIG. 7 of the drawings, there is shown a mechanical system 90 for an amusement device according to a second embodiment. The amusement device according to the second embodiment is substantially the same as that shown in the first embodiment, apart from the mechanical system 90. The mechanical system 90 in this embodiment does not have a hydraulic ram to tension the springs 73 but rather uses a respective winch 91 at the end of each cable 31, 32, each winch 91 being connected to the end of the respective cable 31, 32 remote from the carrier 19. The springs 73 are anchored to a fixed structure 93 at the upper end thereof, and the springs 73 are tensioned by winding each cable 31, 32 onto the respective winch 91.

With this embodiment, the characteristics of the ride provided by the amusement device can be varied by the extent to which the cables 31, 32 are wound onto their respective winches 91.

Referring now to FIGS. 8 to 13 of the drawings, there is shown a mechanical system 100 for an amusement device according to a third embodiment. The amusement device according to the third embodiment is substantially the same as that shown in the first embodiment, with the exception that each cable 31, 32 is in the form of two cable members operating in tandem. More particularly, cable 31 comprises two cable members 101, 102, and cable 32 comprises two cable members 103, 104.

In relation to cable 31, each cable member 101, 102 is connected at one end to the carrier 1 9 and is anchored at its other end to an anchoring point fixed in relation to the mechanical system 100. Similarly, in relation to cable 32, each cable member 103, 104 is connected at one end to the carrier 19 and is anchored at the other end to an anchoring point fixed in relation to the mechanical system 100.

The mechanical system 100 is generally of similar construction to the mechanical system 35 incorporated in the first embodiment, and comprises the frame structure 45 including the base structure 47, the top structure 49, and the four columns 51 extending between the base structure and the top structure, the four columns being positioned one at each corner of the frame structure when viewed in plan.

The upper movable structure 57 and the lower movable structure 59 are each positioned within the frame structure 45 for reciprocatory movement along the guide rails defined by the columns 51. Co-operation between the guide rollers 63 and the guide rails defined by the columns 51 constrain movement of the upper and lower movable structures 57, 59 in a generally vertical direction along the guide rails while allowing a limited degree of side ways tilting movement about a vertical axis corresponding to the direction of travel.

The power device 67 in the form of a hydraulic ram is positioned between the base structure 47 and the upper movable structure 57 for selectively moving the upper movable structure 57 with respect to the base structure 47. The hydraulic ram 67 is operatively connected to the hydraulic pump assembly 68 via fluid lines 69. The pump assembly 68 is connected to a hydraulic fluid reservoir.

Figure 12:
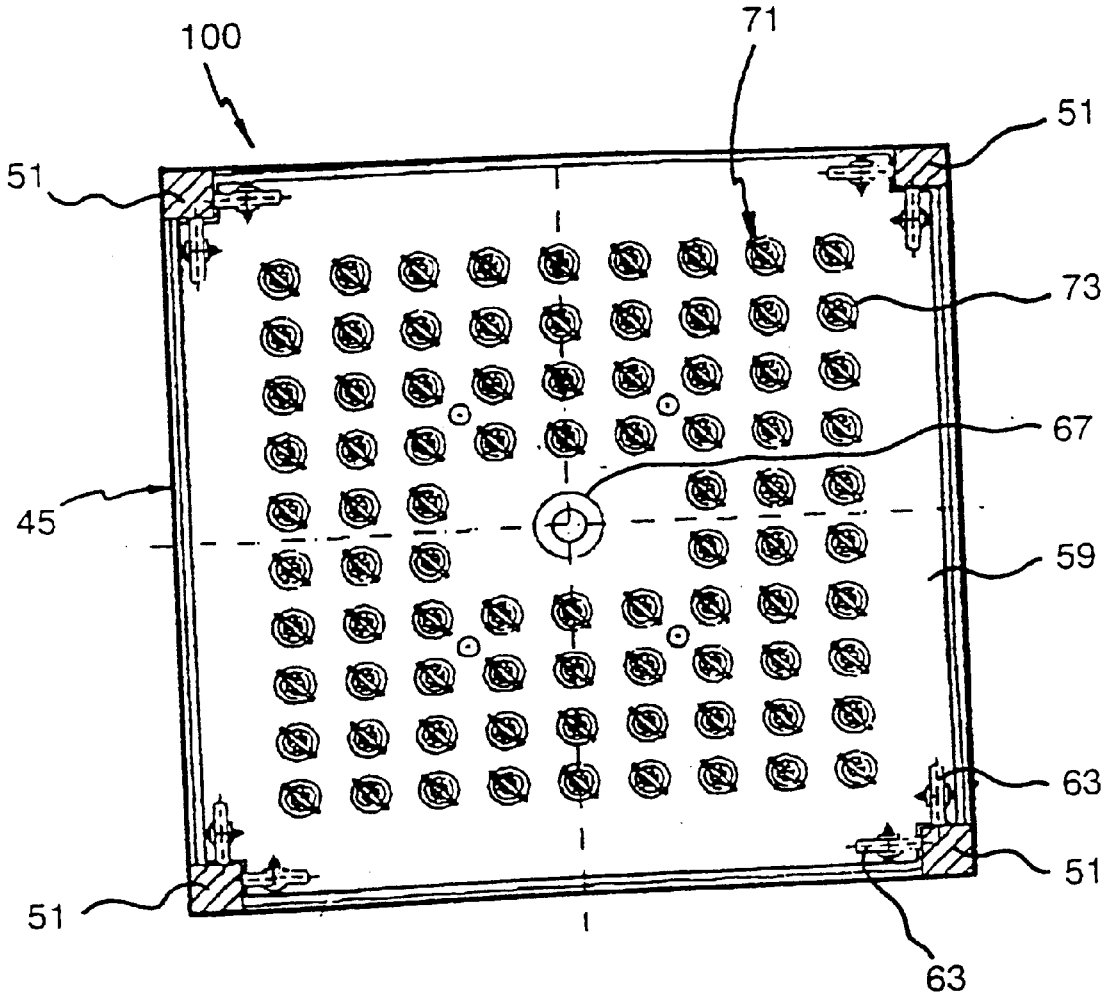
FIG. 12 is a cross-sectional view along line 12—12 of FIG. 9.

The elastic structure 71 is positioned between the upper movable structure 57 and the lower movable structure 59. The elastic structure 71 comprises a plurality of helical compression springs 73 positioned in parallel, with one end of each spring being connected to the upper movable structure and the other end of each spring being anchored to the lower movable structure 59. As shown in FIG. 12 of the drawings, the springs 73 are so positioned in relation to the hydraulic ram 67 as to avoid interference with operation of the ram.

The mechanical system 100 according to this embodiment differs from the mechanical system 35 incorporated in the first embodiment in relation to the pulley wheels 80 about which the cable members 101, 102, 103 and 104 wind.

Figure 13:
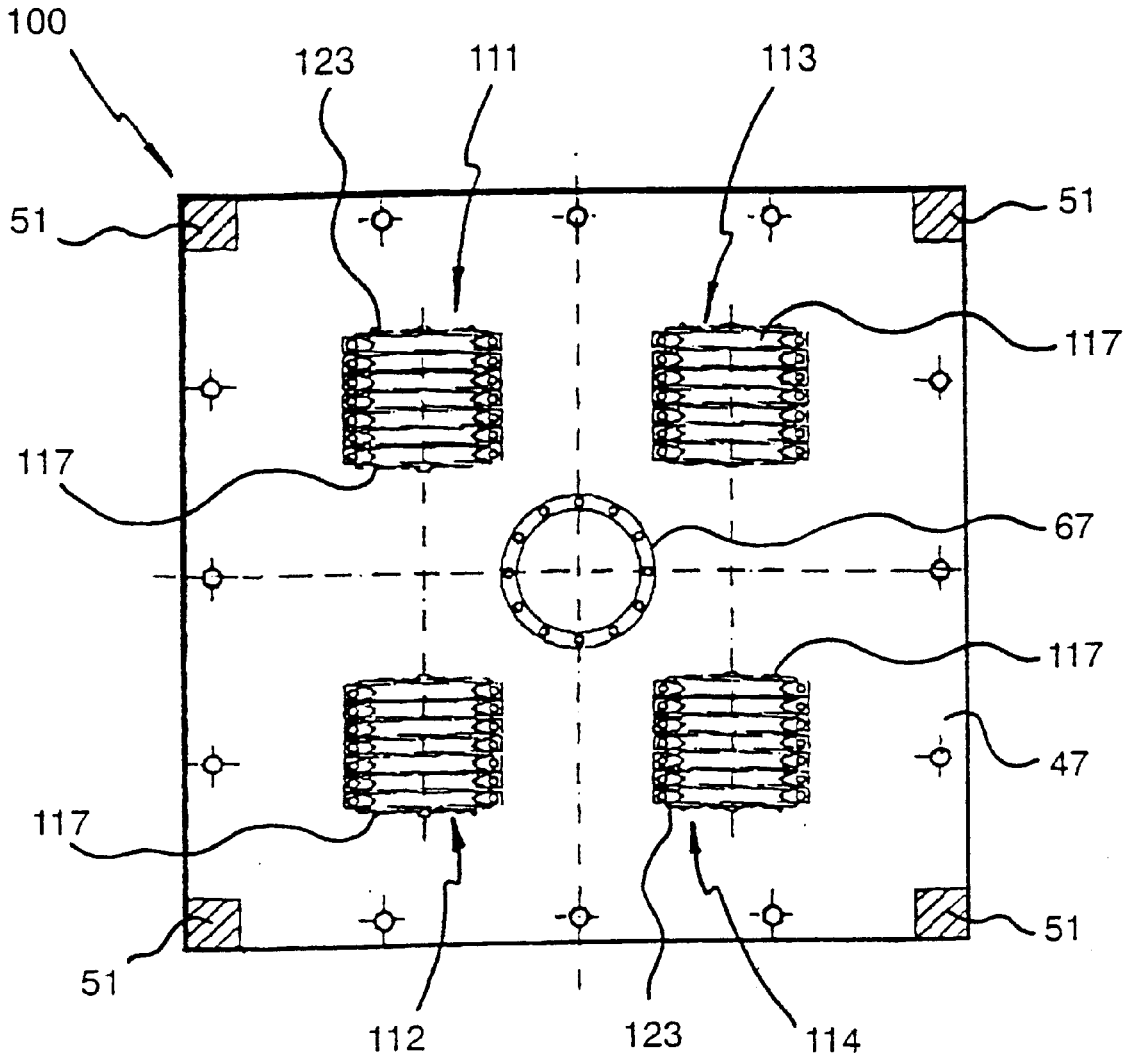
FIG. 13 is a cross-sectional view along line 13—13 of FIG. 9.

The pulley wheels 80 in this embodiment are arranged in four groups 111, 112, 113 and 114, each group being associated with a respective one of the cable members 101, 102, 103 and 104 as will be explained in more detail shortly. The groups are arranged in a somewhat evenly spaced arrangement when viewed in plan, as best seen in FIG. 13.

Each group of pulleys 111, 112, 113 and 114 comprises an upper bank of pulley wheels 115 connected to the lower movable structure 59 and a lower bank of pulley wheels 117 connected to the base structure 47.

The upper bank of pulley wheels 115 comprises a plurality of pulley wheels 121 positioned in side-by-side relationship on a common axle 122. Similarly, the lower bank of pulley wheels 117 comprise a plurality, of pulley wheels 123 positioned in side-by-side relationship on a common axle 124.

Each of the cable members 101, 102, 103 and 104 winds successively between its respective pulley wheels and then extends upwardly within the frame structure 45, passing through an opening in the top structure 49 and around a respective guide pulley 127 mounted on the top structure.

The arrangement whereby the pulley wheels 80 are positioned in evenly-spaced groups 111, 112, 113 and 114 and the cable members 101, 102, 103 and 104 are each associated with respective one of those groups, provides a benefit in that it applies a balanced loading to the lower movable structure 59 causing it to move it more evenly without excessive sideways tilting.

This benefit may be even further enhanced by changing the relationship between the cable members 101, 102, 103 and 104 and the pulley wheel groups 111, 112, 113 and 114. In the present embodiment, cable member 101 is associated with a pulley wheel group 111, cable member 102 is associated with pulley wheel group 112, cable member 103 is associated with pulley wheel group 113 and cable member 104 is associated with pulley wheel group 114. The relationship between the cable members and various pulley groups can be varied to provide a more even distribution of loading. For example, cable member 101 could be associated with pulley wheel group 113 and cable member 103 could be associated with pulley wheel group 111. With such an arrangement, the cable members of each cable 31, 32 are associated with particular pulley wheel groups which are in diagonally opposed relationship to each other.

Figure 14:
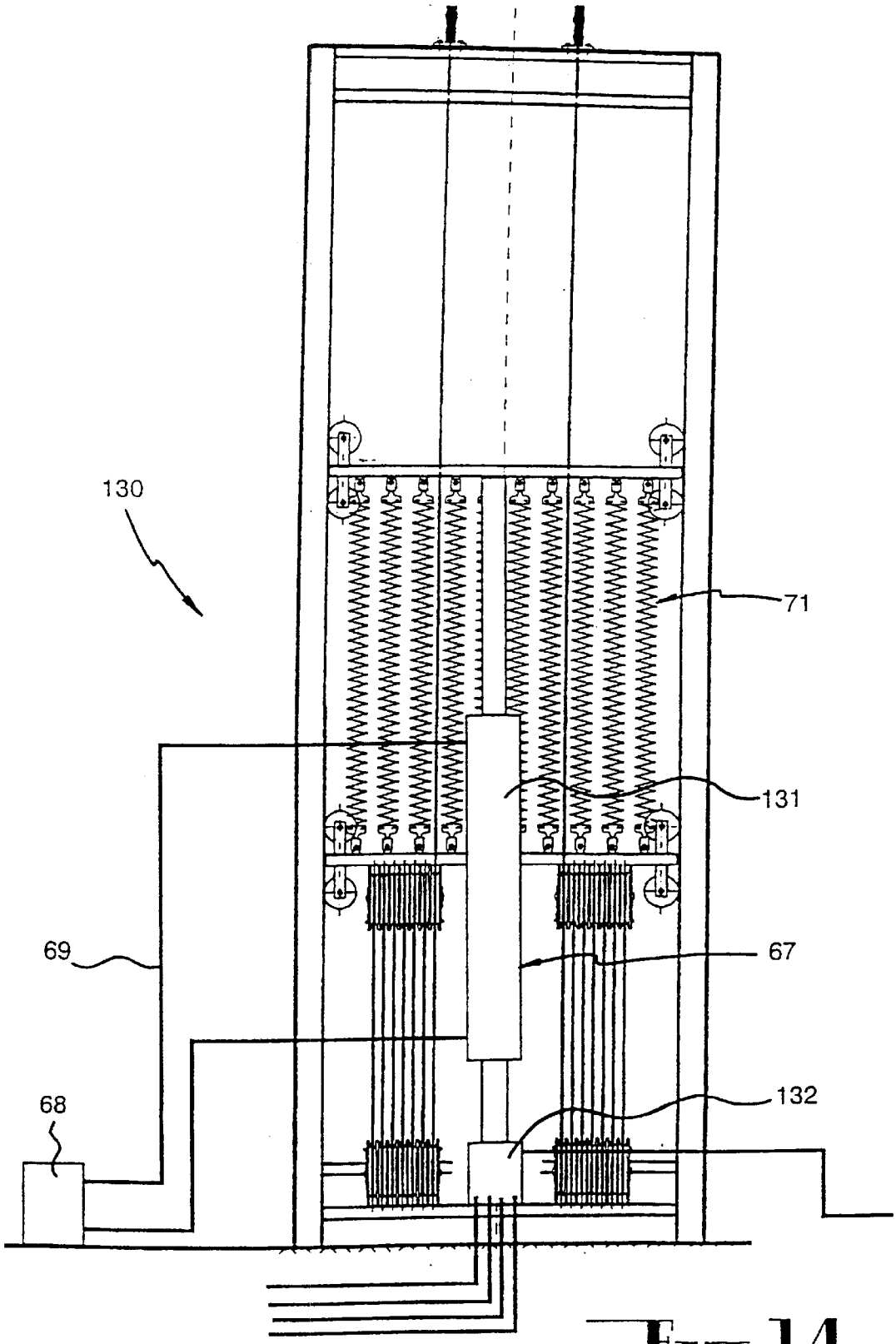
FIG. 14 is a schematic side view of a mechanical system for an amusement device according to a fourth embodiment showing a power device incorporated in the mechanical system.

Referring now to FIG. 14 of the drawings, there is shown a mechanical system 130 for an amusement device according to a fourth embodiment. The amusement device according to the fourth embodiment is substantially the same as that shown in the third embodiment, apart from the power device 67. In this embodiment, the power device 67 has two stages, a first stage for tensioning the elastic structure 71 in the manner described previously in relation to earlier embodiments, and a second stage for selectively imparting a rapid movement to the cables 31, 32 after the carrier 19 has been propelled upwardly from the launch site 17. The purpose of the second stage is to provide further propulsion or a "kick" to the carrier 19 while it is in the air so as to further enhance the thrill provided by the ride.

In this embodiment, the power device 67 is in the form of two hydraulic rams 131, 132 operating in series. The first hydraulic ram 131 corresponds to the first stage of operation and is used to tension the elastic structure 71. The second hydraulic ram 132 is selectively operable while the ride is in operation to provide additional force to the cables 31, 32 in a rapid fashion so as to provide the additional propulsion.

It should be appreciated that the second stage of operation can be delivered in any suitable fashion. For example, rather than having hydraulic rams in series, there may be an arrangement having hydraulic rams in a parallel, with the particular ram which provides the second stage being selectively operable as was previously described. In another arrangement, either one or both of the cables 31, 32 may have a surplus length which is wound onto a reel and selectively unwound while the ride is in operation so as to provide the cables with additional length after the support structure 19 has been launched. A brake mechanism may be provided to prevent unwinding of the reel until such time as the surplus cable is required during operation of the ride.

In the earlier embodiments, the upper movable structure 57 and the lower movable structure 59 are each positioned within the frame structure 45 for reciprocatory movement along guide rails defined by columns 51. Co-operation between the guide rollers 63 and the guide rails defined by the columns 51 constrained movement of the upper and lower movable structures 57, 59 in a generally vertical direction along the guide rails.

Figure 15:
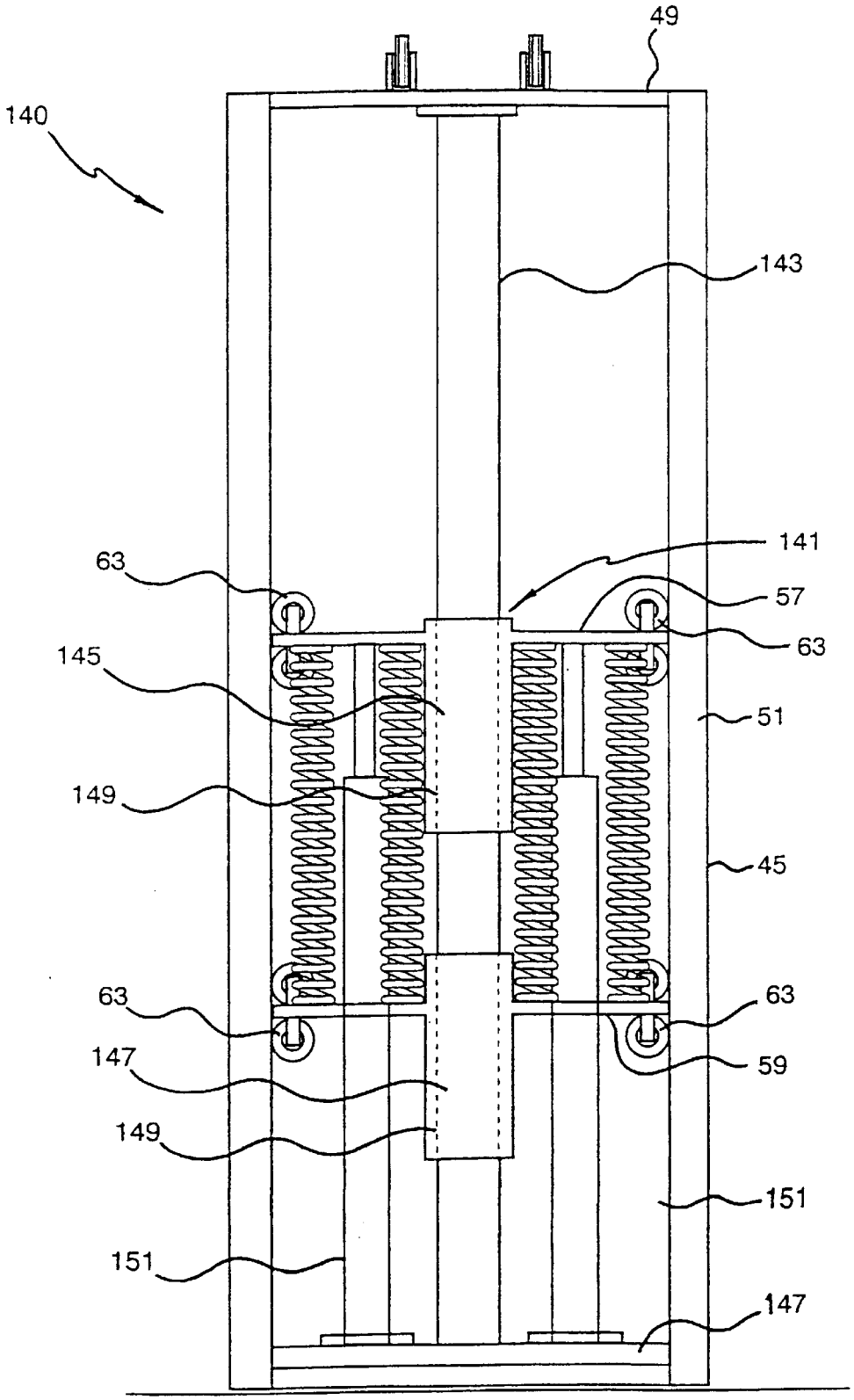
FIG. 15 is a schematic side view of a mechanical system for an amusement device according to a fifth embodiment, showing a guide system incorporated in the mechanical system.

In the embodiment shown in FIG. 15 of the drawings, there is shown a mechanical system 140 for an amusement device according to a fifth embodiment. The amusement device according to the fifth embodiment is substantially the same as shown in the third embodiment, with the exception that a guide structure 141 is provided for guiding movement of the upper movable structure 57 and the lower movable structure 59. The guide structure 141 includes a guide pole 143, which in this embodiment is of circular cross-section, extending between the top structure 49 and base structure 47 of the frame structure 45. The guide pole 143 defines a track on which a carriage 145 associated with the upper movable structure 57, and a carriage 147 associated with the lower movable structure 49, can travel in guided fashion. Each carriage 145, 147 comprises a sleeve 149 fixed to the respective movable structure 57, 59. Guided movement provided by the guide structure 141 is supplemented by the guide arrangement defined by guide rollers 63 travelling along guide rails defined by the columns 51 of the frame structure 45, as was the case in the third embodiment.

In this embodiment, the power device 67 comprises two hydraulic rams 151 operating in parallel and positioned on opposed sides of the guide pole 143. The two hydraulic rams 151 may be connected to a hydraulic circuit through proportional differential valves which ensure that the two hydraulic rams operate in unison. It is found that use of the guide structure 141, together with the two hydraulic rams 153 positioned on opposed sides of the guide pole 143, provides a simple yet highly effective arrangement for guiding movement of the upper movable structure 57 and the lower movable structure 59 in a way which avoids jamming as they undergo reciprocatory movement.

The previous embodiments have been directed to amusement devices which are so-called "sling-shots" in which participants are propelled upwardly. A cable and mechanical system of the type described in relation to the earlier embodiments can be used in bungee jumping operations and reverse bungee jumping operations.

In a bungee jumping operation, there would be no need to subject the spring system to an initial tensioning operation. The cable would simply be attached to the participant who would then jump from a tower or other elevated site in the usual manner. The decent of the participant would be retarded by elastic tensioning of the cable through loading of the spring system in the mechanical system. During loading of the spring system, energy is stored in the spring system and is subsequently released to the cable to apply an uplifting force to the participant to impart a vertically oscillatory motion to the participant. One such amusement device is the subject of a sixth embodiment shown in FIGS. 16, 17 and 18 of the drawings.

Figure 16:
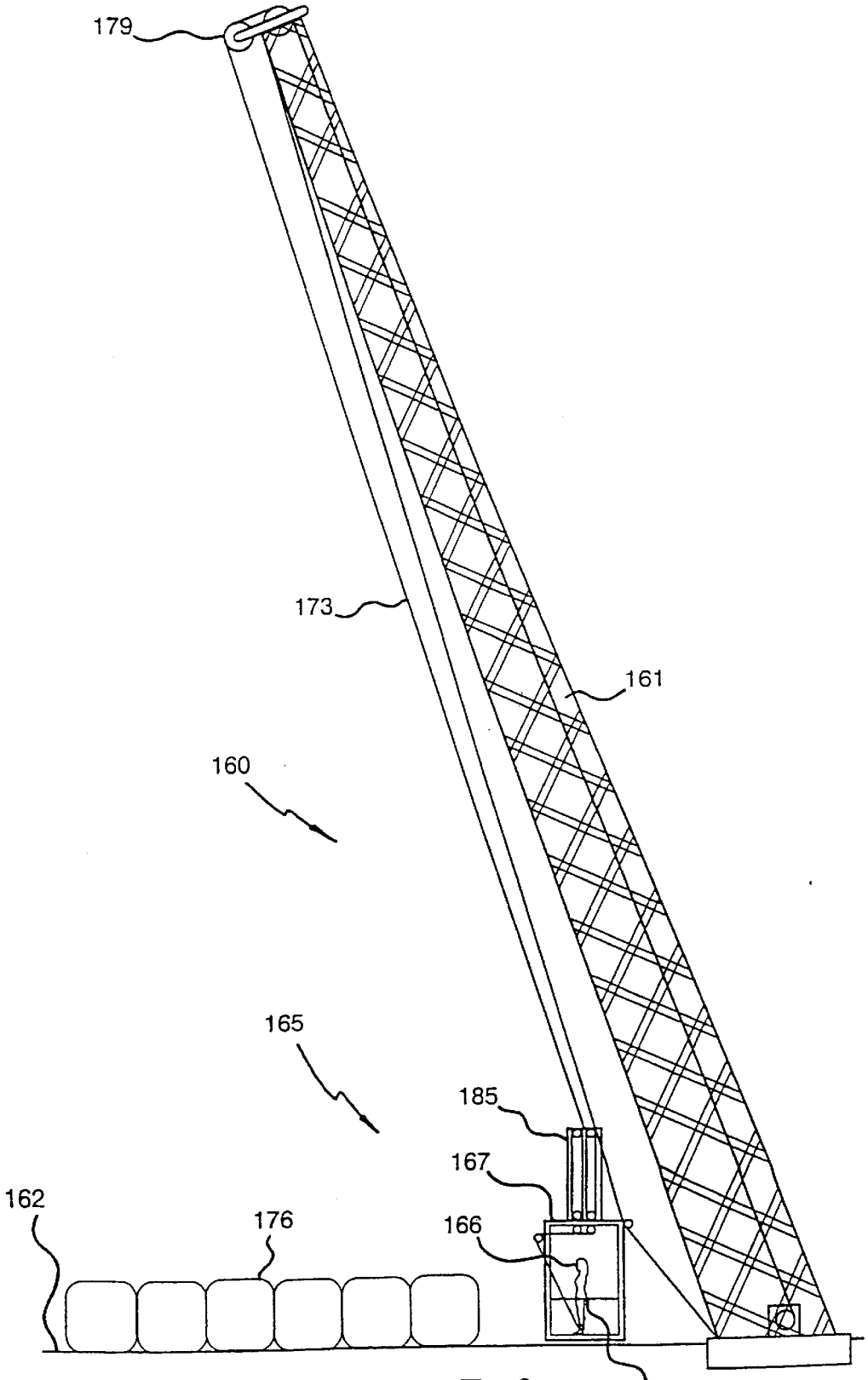
FIG. 16 is a schematic side view of an amusement device according to a sixth embodiment, the amusement device being shown in a condition in which a participant has entered the device.
Figure 17:
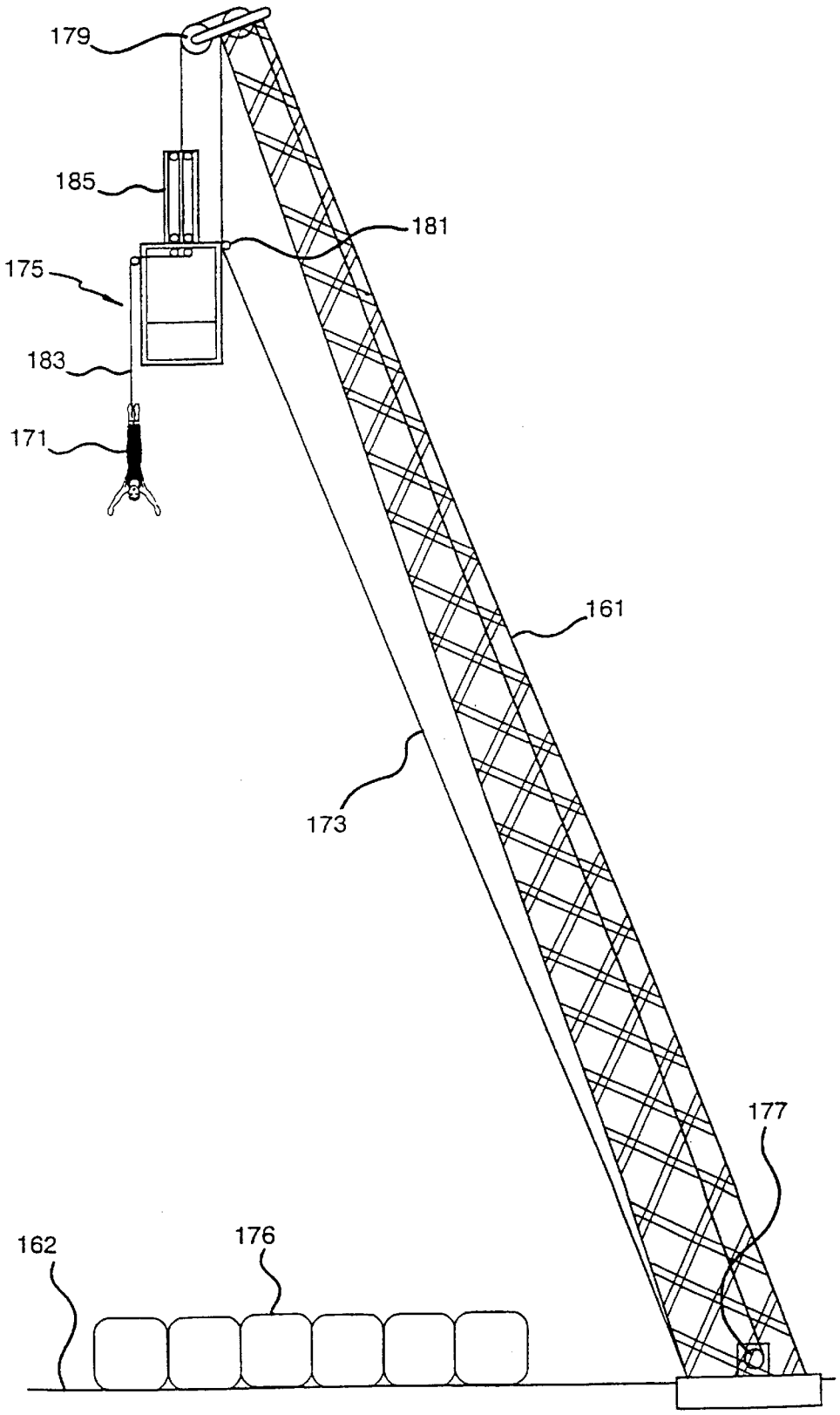
FIG. 17 is a view similar to FIG. 16, with the exception that the amusement device is shown in use.
Figure 18:
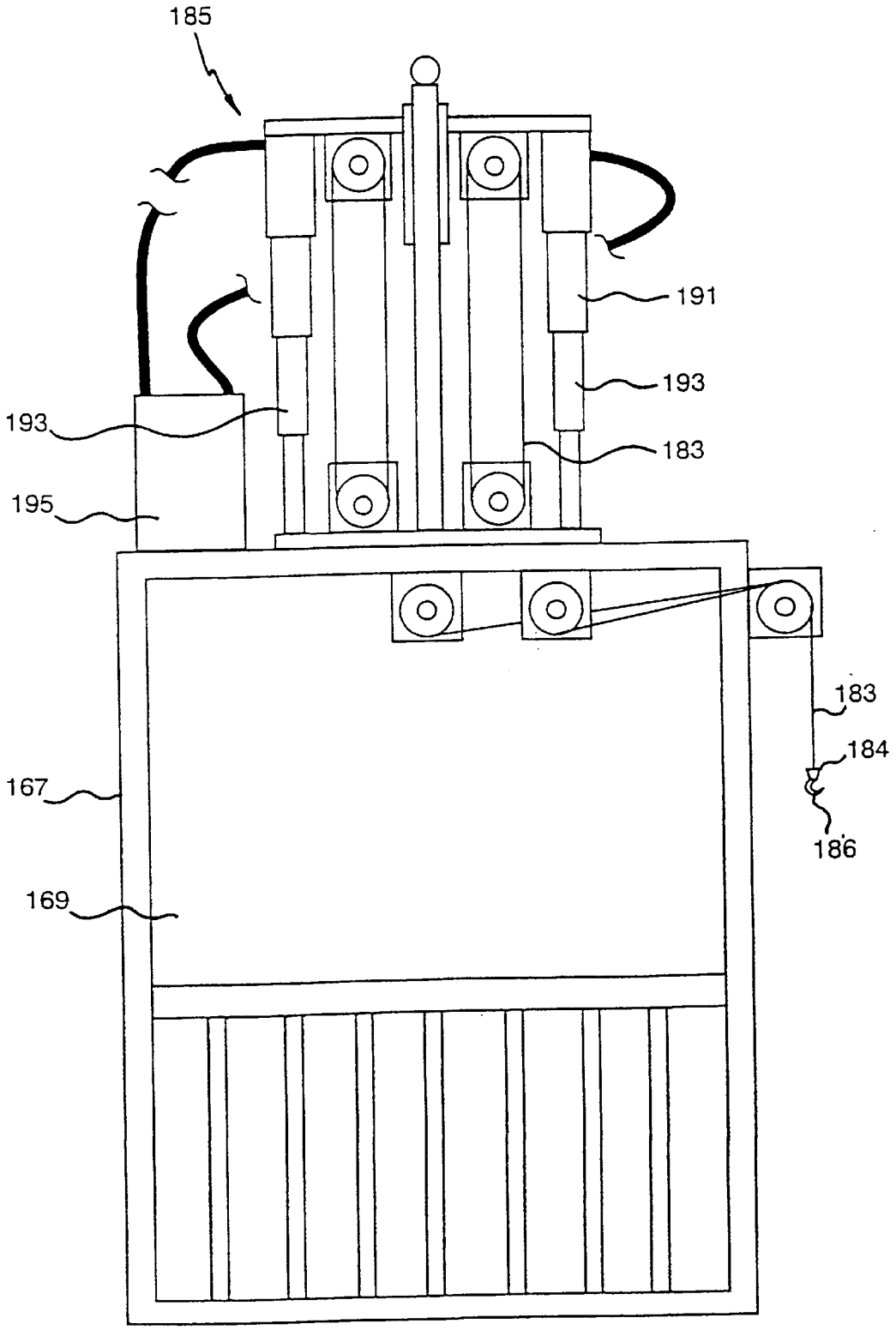
FIG. 18 is a schematic side view of a participant support structure and associated mechanical system employed in the amusement device of FIG. 16.

The amusement device 160 shown in FIGS. 16, 17 and 18 of the drawings comprises a tower structure 161 anchored to the ground 162. A boarding station 165 is located at ground level adjacent the base of the tower structure. A support structure in the form of a carrier 167 can be positioned at the boarding station 165. The carrier 167 is somewhat in the form of a gondola and includes a compartment 169 into which a participant 171 can enter.

The carrier 167 is supported on a cable system 173 which can convey the carrier 167 from the boarding station 165 as illustrated in FIG. 16 of the drawings to a launching station 175 towards the top of the tower structure 161 and elevated in relation to the ground 163, as illustrated in FIG. 17 of the drawings. A safety cushioning system 176 is provided on the ground 162 below the launching station 175.

The cable 173 extends between the carrier 167 and a winch 177 located at the base of the tower structure 161. The cable 163 passes around the pulley wheels 179 at the top of the tower structure 161 and through a guide pulley 181 positioned on the carrier 167. With this arrangement, operation of the winch 177 can move the carrier 167 between the boarding and launch stations.

The participant 171 is attached to one end 184 of a cable 183 which is associated with a mechanical system 185 accommodated on the carrier 167 above the compartment 169. An attachment mechanism 186 is provided for releasably attaching the end 184 of the cable 183 to the legs of the participant 171, in a manner similar to conventional bungee jumping operations.

The participant 171 jumps from the compartment 169 in a similar fashion to a bungee jumping operation. The descent of the participant 171 is retarded by elastic tensioning of the cable 183 through the mechanical system 185.

The mechanical system 185 employs a compression spring system 191 comprising pneumatic springs 193 in the form of air cylinders. The air cylinders are operatively connected to a compressor 195 mounted onboard the carrier 167. The compressor 195 can deliver air at prescribed pressure to the pneumatic cylinders 193 according to safety requirements and the desired ride characteristics. For example, the weight of the participant can be evaluated and a determination made as to the extent of pressure required within the air cylinders 193 in order to provide a safe ride and also the desired ride characteristics. This may operate under a computer-controlled system.

Figure 19:
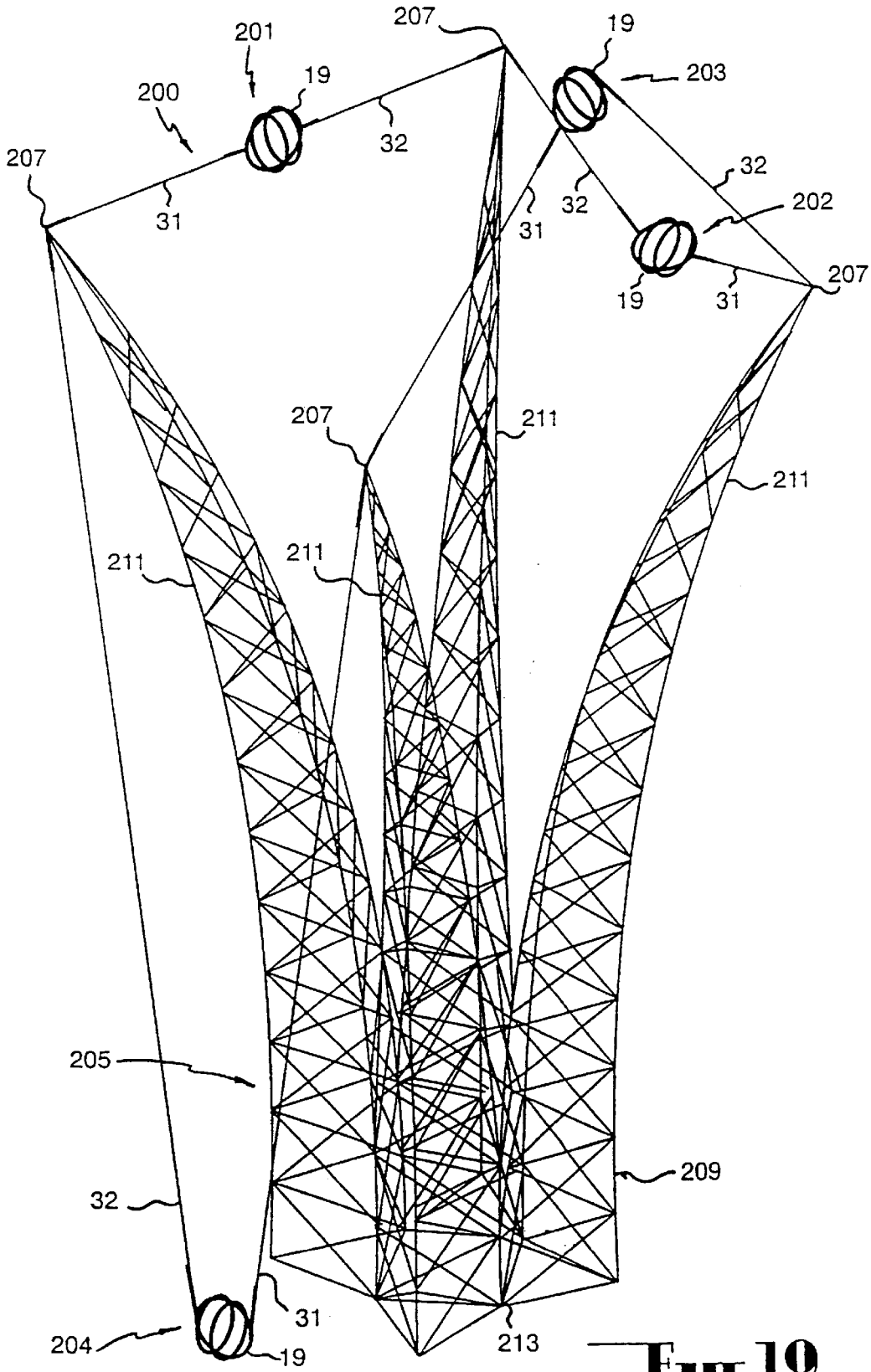
FIG. 19 is a schematic perspective view of an amusement device according to a seventh embodiment.
Figure 20:
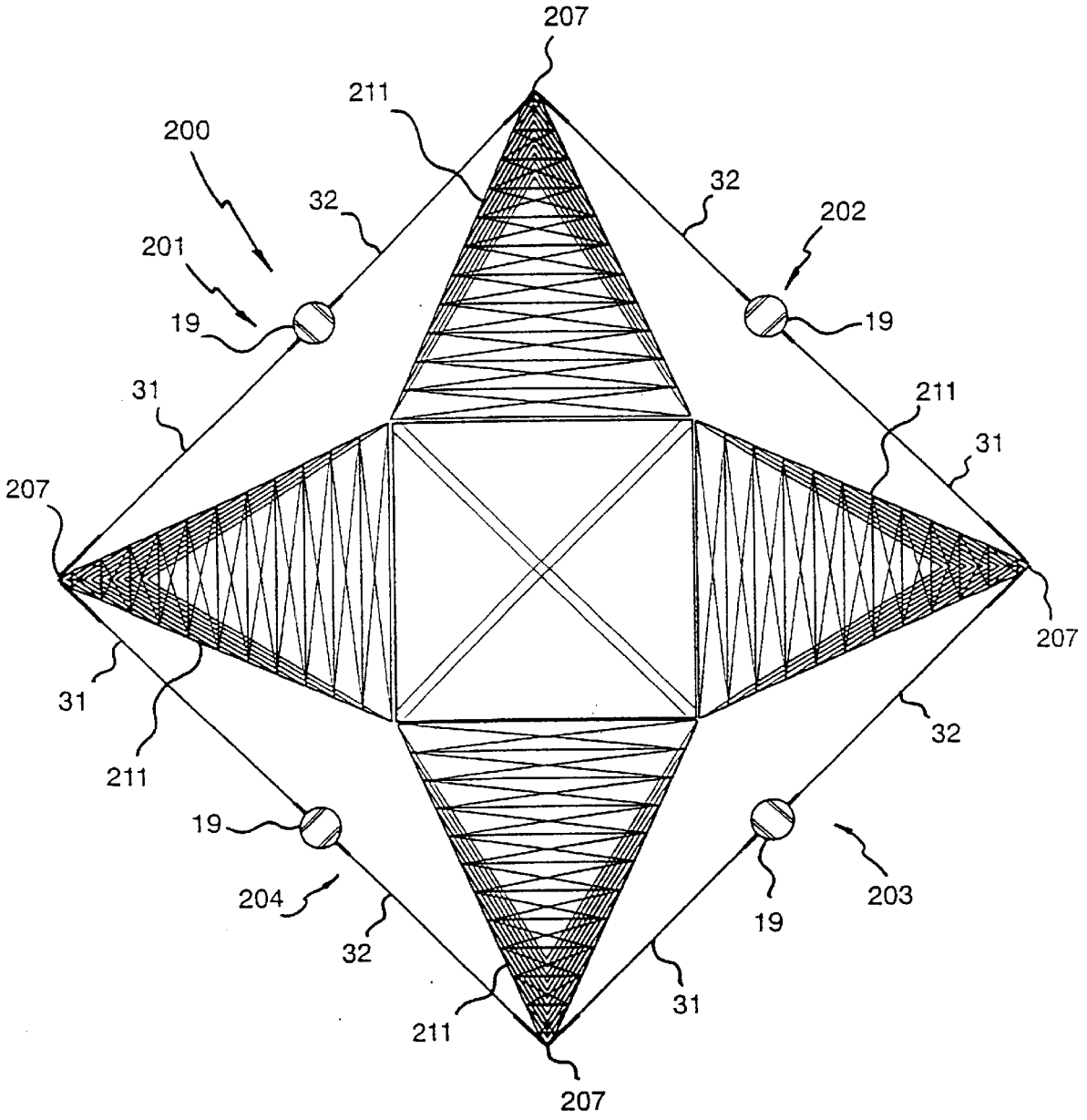
FIG. 20 is a plan view of the amusement device shown in FIG. 19.

Referring now to FIGS. 19 and 20, there is shown an assembly 200 which provides several amusement devices each of which operates in a similar fashion to the amusement device shown in the first embodiment. In the first embodiment, the amusement device provides a single ride in the sense that the carrier 19 was suspended between cables 31, 32 each of which was associated with the two towers 11.

The embodiment shown in FIGS. 19 and 20 differs from the first embodiment in that there is provided an assembly which offers a multitude of rides, there being four such rides in this embodiment being identified by reference numerals 201, 202, 203 and 204. The rides 201, 202, 203 and 204 utilise a common tower structure 205 which define elevated support locations 207 about which cables 31, 32 of the various rides pass.

The common tower structure 205 comprises a central section 209 and a plurality of lateral sections 211 (there being four such lateral sections in this embodiment). Each lateral section 211 is in the form of an arched jib so as to provide a horizontal reach between the perspective support location 207 and the base 213 of the structure 205. With this arrangement, each arched jib provides a support location 207 for two neighbouring rides.

The common tower structure 205 is of a space frame construction with the various arched jibs being interconnected at the lower regions thereof to provide the central section 209.

A particular advantage of this embodiment is that it is necessary to construct only one tower structure which then provides support locations for a multitude of rides. Where the amusement device is installed in an environment such as a theme park, it is advantageous to have a facility which provides a multitude of rides in that the waiting time for riders is reduced. An additional benefit is that the rides can be arranged to offer different ride characteristics; for example, the rides may be structured to offer different intensities and/or experiences to riders.

From the foregoing, it is evident that the amusement devices according to the invention utilises a mechanical system involving cables, as opposed to elastic cords, for operation. This is particularly advantageous as cables are well-understood mechanical devices which are predictable in their nature and operation. This would allow operators of the amusement devices to more easily obtain insurance for such amusement devices. On the other hand, amusement devices utilising elastic cords have some uncertainties by virtue of the unpredictable nature of rubber used in the strands which are assembled to form the elastic cords. Furthermore, it can be difficult to assess the condition of the elastic cords. For such reasons, it possibly may be difficult to obtain appropriate insurance for such amusement devices.

A further benefit of an amusement device according to the invention is that the characteristics of the ride can be varied according to the extent to which the spring system is loaded. For example, the loading applied to the spring system may be different when the participant is a small child as compared to two large adults. Accordingly, the ride characteristics can be tailored according to the physical attributes and wishes of the participants. This is not possible for conventional "sling-shot" machines which utilise elastic cords. In such "sling-shot" machines, it is necessary to stretch the elastic cords to the full extent available in order to ensure proper operation of the rides. The requirement to fully stretch the elastic cords for proper operation means that it is not possible to vary the elastic tension in order to regulate the ride characteristics.

It should be appreciated that the scope of the invention is not limited to the scope of the various embodiments described.

Throughout the specification, unless the context requires otherwise, the word "comprise" or variations such as "comprises" or "comprising", will be understood to imply the inclusion of a stated integer or group of integers but not the exclusion of any other integer or group of integers.

The claims defining the invention are as follows:

1. An amusement ride for lifting a rider from a starting height to a higher elevation, and from said higher elevation pulling the rider to a somewhat lower elevation, and then continuing to move said rider in a repetitive up and down motion, said up and down motion decreasing in amplitude over time, comprising:

(a) a rider carrier member;

(b) a ground system;

(c) a releasable latch for securing said rider carrier member to said ground system an, in response to actuation of said ride, releasing said rider carrier member;

(d) a first cable member section having first and second ends, said first cable member section secured at said first end to said rider carrier member;

(e) a first elastic member having first and second ends;

(f) a mechanical advantage mechanism, said mechanical advantage mechanism having an input point and an output point, the mechanical advantage of said mechanical advantage mechanism being less than one, said input point being coupled to said first end of said first elastic member, and said output point being coupled to said second end of said first cable member section;

(g) a first support member, said second end of said first elastic member secured to said first support member;

(h) an engine coupled to said first support member and said mechanical advantage mechanism for increasing and decreasing the distance between said first and second ends of said first elastic member.

2. An amusement ride as in claim 1, further comprising a plurality of additional elastic members, each of said additional elastic members having a first end and a second end, said first ends of said additional elastic members being coupled to each other and to said first end of said first elastic member and said second ends of said additional elastic members being coupled to each other and to said second end of said first elastic member.

3. An amusement ride as in claim 2, wherein said mechanical advantage mechanism is coupled to said ground system.

4. An amusement ride as in claims, further comprising a plurality of pulleys for guiding said first cable member section from said mechanical advantage mechanism to said rider carrier member along a path which extends upwardly from said rider carrier member and downwardly toward said mechanical advantage mechanism.

5. An amusement ride as in claim 4, wherein said output point on said mechanical advantage mechanism comprises a second cable portion, and said mechanical advantage mechanism is configured to pay out said second cable portion at a first rate and stretch said elastic member at a second rate in response to the pay out of said second cable and in proportion to the pay out of said second cable, said first rate being greater than said second rate.

6. An amusement ride as in claim 5, further comprising a plurality of pulleys for guiding said first cable member section from said mechanical advantage mechanism to said rider carrier member along a path which extends upwardly from said rider carrier member and downwardly toward said mechanical advantage mechanism.

7. An amusement ride as in claim 2, wherein said output point on said mechanical advantage mechanism comprises a second cable portion, and said mechanical advantage mechanism is configured to pay out said second cable portion at a first rate and stretch said elastic member at a second rate in response to the pay out of said second cable and in proportion to the pay out of said second cable, said first rate being greater than said second rate.

8. An amusement ride as in claims 1, wherein said elastic member comprises a spring.

9. An amusement ride as in claim 8, further comprising a plurality of pulleys for guiding said first cable member section from said mechanical advantage mechanism to said rider carrier member along a path which extends upwardly from said rider carrier member and downwardly toward said mechanical advantage mechanism.

10. An amusement ride as in claim 9, wherein said output point on said mechanical advantage mechanism comprises a second cable portion, and said mechanical advantage mechanism is configured to pay out said second cable portion at a first rate and stretch said elastic member at a second rate in response to the pay out of said second cable and in proportion to the pay out of said second cable, said first rate being greater than said second rate.

11. An amusement ride as in claim 1, wherein said mechanical advantage mechanism is coupled to said ground system.

12. An amusement ride as in claim 11, further comprising a plurality of pulleys for guiding said first cable member section from said mechanical advantage mechanism to said rider carrier member along a path which extends upwardly from said rider carrier member and downwardly toward said mechanical advantage mechanism.

13. An amusement ride as in claim 12, wherein said output point on said mechanical advantage mechanism comprises a second cable portion, and said mechanical advantage mechanism is configured to pay out said second cable portion at a first rate and stretch said elastic member at a second rate in response to the pay out of said second cable and in proportion to the pay out of said second cable, said first rate being greater than said second rate.

14. An amusement ride as in claim 11, wherein said output point on said mechanical advantage mechanism comprises a second cable portion, and said mechanical advantage mechanism is configured to pay out said second cable portion at a first rate and stretch said elastic member at a second rate in response to the pay out of said second cable and in proportion to the pay out of said second cable, said first rate being greater than said second rate.

15. An amusement ride as in claim 1, wherein said mechanical advantage mechanism comprises:

(I) a second cable member section having first and second ends, said second cable member section coupled at said first end of said second cable member section to said first end of said elastic member or to said ground system.

16. An amusement ride as in claim 15, wherein said mechanical advantage mechanism further comprises:

(II) a cylindrical member support secured to said ground system; and (III) a cylindrical member mounted for rotation on said cylindrical member support, a portion of said second cable member section extending around said cylindrical member, said portion of said second cable member section being between said first and second ends of said second cable member section.

17. An amusement ride as in claim 16, wherein said mechanical advantage mechanism further comprises:

(IV) a plurality of additional cylindrical members mounted for rotation on said cylindrical member support, said additional cylindrical members and said cylindrical member positioned to cooperate as first pulley members;

(V) a pulley support member secured to said first end of said first elastic member and securing said first end of said first elastic member to said mechanical advantage mechanism; and (VI) a plurality of second pulley members mounted for rotation on said pulley support member, said portion of said second cable member section extending alternately around said first pulley members and said second pulley members.

18. An amusement ride as in claim 17, wherein said second cable member section and said first cable member section are parts of a single cable.

19. An amusement ride as in claim 1, further comprising a plurality of pulleys for guiding said first cable member section from said mechanical advantage mechanism to said rider carrier member along a path which extends upwardly from said rider carrier member and downwardly toward said mechanical advantage mechanism.

20. An amusement ride as in claim 1, wherein said output point on said mechanical advantage mechanism comprises a second cable portion, and said mechanical advantage mechanism is configured to pay out said second cable portion at a first rate and stretch said elastic member at a second rate in response to the pay out of said second cable and in proportion to the pay out of said second cable, said first rate being greater than said second rate.

21. An amusement ride as in claim 1, wherein said engine is a mechanical engine.

22. An amusement ride as in claim 1, wherein said engine is a hydraulic cylinder.

23. A method for lifting a rider in a rider carrier member from a starting height relative to the ground to a higher elevation, and from said higher elevation pulling the rider to a somewhat lower elevation, and then continuing to move said rider in a repetitive up and down motion, said up and down motion decreasing in amplitude over time, as an amusement ride, comprising the steps of:

(a) releasably securing said rider carrier member to said ground;

(b) coupling said rider carrier member to a mechanical advantage mechanism, said mechanical advantage mechanism having an input point and an output point, said mechanical advantage mechanism delivering a mechanical advantage of less than one, and said output point of said mechanical advantage mechanism being coupled to said rider carrier member;

(c) said input point of said mechanical advantage mechanism being coupled to a first end of a first elastic member;

(d) stretching said first elastic member by applying force to said second end of said first elastic member in a direction away from said first end of said first elastic member, said first end of said first elastic member being held against the force of said first elastic member by the coupling of said first end by said mechanical advantage mechanism to said ground;

(e) after said first elastic member has been stretched, releasing said rider carrier member from said ground allowing said first elastic member to rise in altitude and vibrate up and down in response to forces provided by said stretched first elastic member.

24. A method as in claim 23, wherein said stretching comprises stretching a plurality of additional elastic members which cooperate with said first elastic member to store more energy than said first elastic member.

25. A method as in claim 23, further comprising coupling said mechanical advantage mechanism to the ground.

26. A method as in claim 23, wherein said mechanical advantage is provided by a second cable member section to said first end of said elastic member or to said ground.

27. A method as in claim 20, wherein said mechanical advantage is provided by a cylindrical member mounted for rotation on a cylindrical member support with a portion of said second cable member section extending around said cylindrical member.

28. A method as in claim 27, wherein said mechanical advantage is provided by a plurality of additional cylindrical members mounted for rotation, said additional cylindrical members and said cylindrical member cooperating as pulley members.

29. A method as in claim 28, wherein a plurality of pulleys guide a cable member section extending from said mechanical advantage mechanism to said rider carrier member along a path extending upwardly from said rider carrier member and downwardly toward said mechanical advantage mechanism, to achieve said coupling of said rider carrier member to said mechanical advantage mechanism.

30. A method as in claim 23, wherein said output point on said mechanical advantage mechanism pays out a cable portion at a first rate to stretch said elastic member at a second rate in response to said pay out of said cable and in proportion to said pay out of said second cable, said first rate being greater than said second rate.

31. A method as in claim 23, wherein said stretching is hydraulically achieved.

32. An amusement ride for lifting a rider from a starting height to a higher elevation, and from said higher elevation pulling the rider to a somewhat lower elevation, and then continuing to move said rider in a repetitive up and down motion, said up and down motion decreasing in amplitude over time, comprising:

(a) a rider carrier member;

(b) a ground system;

(c) a releasable latch for securing said rider carrier member to said ground system and, in response to actuation of said ride, releasing said rider carrier member;

(d) a first cable member section having first and second ends, said first cable member section secured at said first end to said rider carrier member;

(e) an energy storage system;

(f) a mechanical advantage mechanism, said mechanical advantage mechanism having an input and an output, the mechanical advantage of said mechanical advantage mechanism being less than one, said input being coupled to said energy storage system, and said output being coupled to said second end of said first cable member section;

(g) a first support member, said second end of said first elastic member secured to said first support member;

(h) an engine coupled to said energy storage system for inputting energy into said energy storage system.

33. An amusement ride as in claim 32, wherein a plurality of pulleys guide a cable member section extending from said mechanical advantage mechanism to said rider carrier member along a path extending upwardly from said rider carrier member and downwardly toward said mechanical advantage mechanism, to achieve said coupling of said rider carrier member to said mechanical advantage mechanism.

* * * * *